US007936266B2

(12) United States Patent
Francis et al.

(10) Patent No.: US 7,936,266 B2
(45) Date of Patent: May 3, 2011

(54) SHIPPING CONTAINER SEAL MONITORING DEVICE, SYSTEM AND METHOD

(75) Inventors: Richard Hugh Francis, Candiac (CA); James Edward Mandry, N. Andover, MA (US); David James Holigan, Atkinson, NH (US); Douglas Webster Prince, S. Sutton, NH (US); Ed Allen Vrablik, Acton, MA (US)

(73) Assignee: Maritime Container Security, Inc., North Andover, MA (US)

( * ) Notice: Subject to any disclaimer, the term of this patent is extended or adjusted under 35 U.S.C. 154(b) by 225 days.

(21) Appl. No.: 11/926,669

(22) Filed: Oct. 29, 2007

(65) Prior Publication Data

US 2008/0252084 A1 Oct. 16, 2008

Related U.S. Application Data

(60) Provisional application No. 60/855,090, filed on Oct. 27, 2006.

(51) Int. Cl.
*G08B 13/08* (2006.01)

(52) U.S. Cl. ..... 340/545.1; 340/539.13; 340/539.19; 340/539.31; 340/568.1; 340/568.2

(58) Field of Classification Search ..... 340/538.17, 340/539.13, 539.22, 545.1, 539.31
See application file for complete search history.

(56) References Cited

U.S. PATENT DOCUMENTS 4,523,186 A * 6/1985 Fiarman ..... 340/555
4,665,385 A * 5/1987 Henderson ..... 340/539.26
4,750,197 A * 6/1988 Denekamp et al. ..... 455/404.2
5,051,723 A * 9/1991 Long et al. ..... 340/566
5,074,137 A * 12/1991 Harris et al. ..... 73/31.02
5,097,253 A * 3/1992 Eschbach et al. ..... 340/545.1
5,481,245 A * 1/1996 Moldavsky ..... 340/540
5,568,121 A * 10/1996 Lamensdorf ..... 340/539.17
5,582,447 A * 12/1996 Leon et al. ..... 292/307 R
5,656,996 A * 8/1997 Houser ..... 340/541
5,912,619 A * 6/1999 Vogt ..... 340/545.1
6,031,455 A * 2/2000 Grube et al. ..... 340/539.26
6,069,563 A * 5/2000 Kadner et al. ..... 340/571
6,215,404 B1 * 4/2001 Morales ..... 340/577
6,259,956 B1 * 7/2001 Myers et al. ..... 700/80
6,700,533 B1 * 3/2004 Werb et al. ..... 342/357.07
6,751,452 B1 * 6/2004 Kupczyk et al. ..... 455/345
6,870,476 B2 * 3/2005 Cockburn et al. ..... 340/541
6,919,803 B2 * 7/2005 Breed ..... 340/539.14
6,972,682 B2 * 12/2005 Lareau et al. ..... 340/568.1
7,019,683 B2 * 3/2006 Stevens et al. ..... 342/28
7,068,149 B2 * 6/2006 Lee et al. ..... 340/286.06
7,068,162 B2 * 6/2006 Maple et al. ..... 340/539.11
7,116,223 B2 * 10/2006 Stern et al. ..... 340/568.1
7,129,837 B2 * 10/2006 Shannon et al. ..... 340/539.13

(Continued)

*Primary Examiner* — Daniel Wu
*Assistant Examiner* — Son M Tang
(74) *Attorney, Agent, or Firm* — Edell, Shapiro & Finnan, LLC

(57) ABSTRACT

A container seal device is provided that comprises a seal device for a shipping container, comprising a first unit that is affixed to a shipping container. A control system is contained in the first unit containing a control system. A second unit is provided that is configured to engage with an element of a door of a shipping container to which the first unit is affixed and to electrically connect with the control system in the first unit. The control system in the first unit is configured to detect a breach of the second unit indicative of access being made to the shipping container.

20 Claims, 27 Drawing Sheets

U.S. PATENT DOCUMENTS 7,239,238 B2 * 7/2007 Tester et al. ..... 340/539.31
7,339,460 B2 * 3/2008 Lane et al. ..... 340/438
7,417,543 B2 * 8/2008 Bergman et al. ..... 340/545.6
7,471,203 B2 * 12/2008 Worthy et al. ..... 340/572.1
7,564,350 B2 * 7/2009 Boman et al. ..... 340/545.6
2002/0061758 A1 * 5/2002 Zarlengo et al. ..... 455/517
2002/0070858 A1 * 6/2002 Gutta et al. ..... 340/541
2004/0066328 A1 * 4/2004 Galley et al. ..... 342/357.1

* cited by examiner

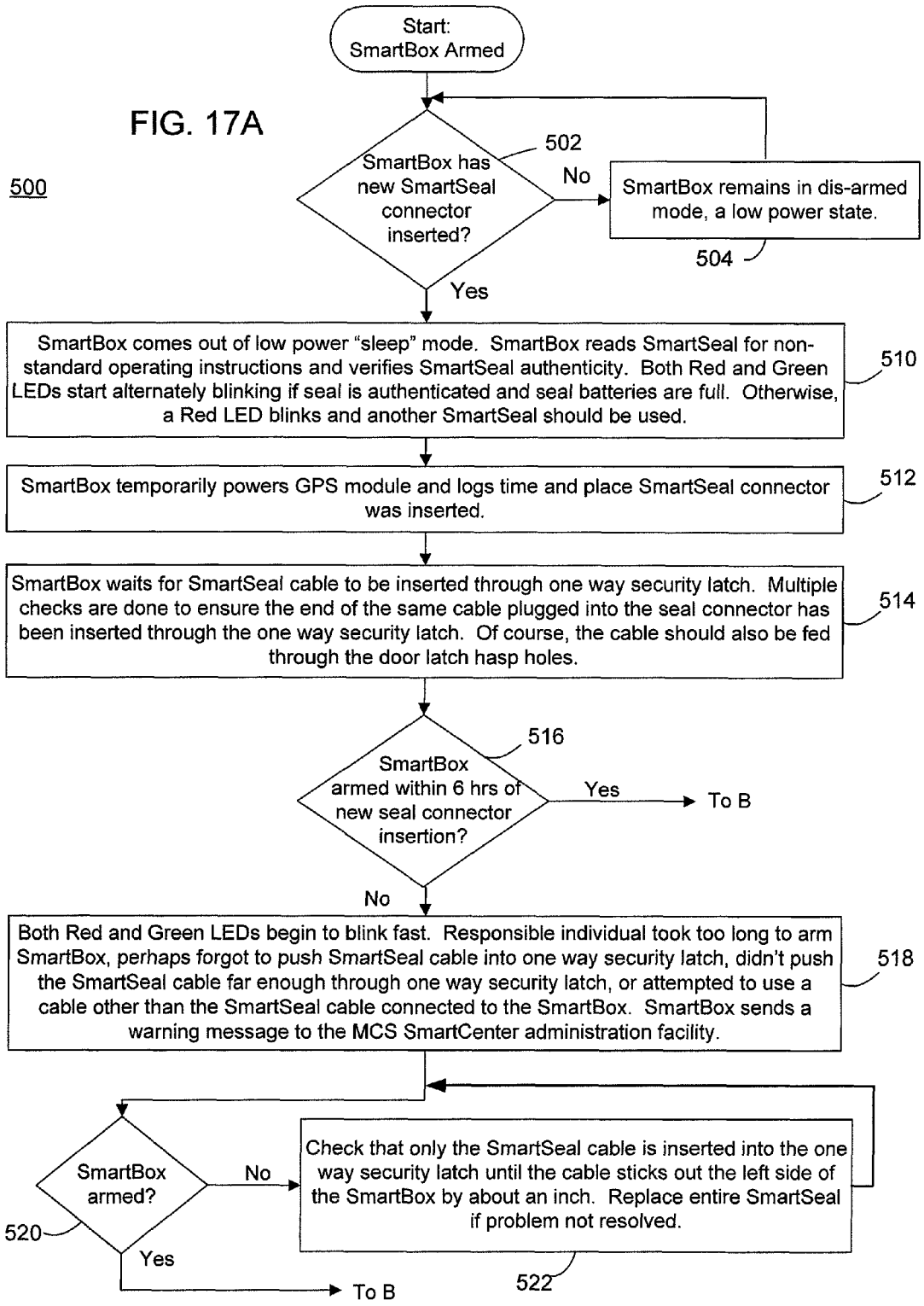
FIG. 17A
500
Start: SmartBox Armed
SmartBox has new SmartSeal connector inserted?
502
No
SmartBox remains in dis-armed mode, a low power state.
504
Yes
SmartBox comes out of low power "sleep" mode. SmartBox reads SmartSeal for non-standard operating instructions and verifies SmartSeal authenticity. Both Red and Green LEDs start alternately blinking if seal is authenticated and seal batteries are full. Otherwise, a Red LED blinks and another SmartSeal should be used.
510
SmartBox temporarily powers GPS module and logs time and place SmartSeal connector was inserted.
512
SmartBox waits for SmartSeal cable to be inserted through one way security latch. Multiple checks are done to ensure the end of the same cable plugged into the seal connector has been inserted through the one way security latch. Of course, the cable should also be fed through the door latch hasp holes.
514
SmartBox armed within 6 hrs of new seal connector insertion?
516
Yes
To B
No
Both Red and Green LEDs begin to blink fast. Responsible individual took too long to arm SmartBox, perhaps forgot to push SmartSeal cable into one way security latch, didn't push the SmartSeal cable far enough through one way security latch, or attempted to use a cable other than the SmartSeal cable connected to the SmartBox. SmartBox sends a warning message to the MCS SmartCenter administration facility.
518
SmartBox armed?
520
No
Check that only the SmartSeal cable is inserted into the one way security latch until the cable sticks out the left side of the SmartBox by about an inch. Replace entire SmartSeal if problem not resolved.
522
Yes
To B

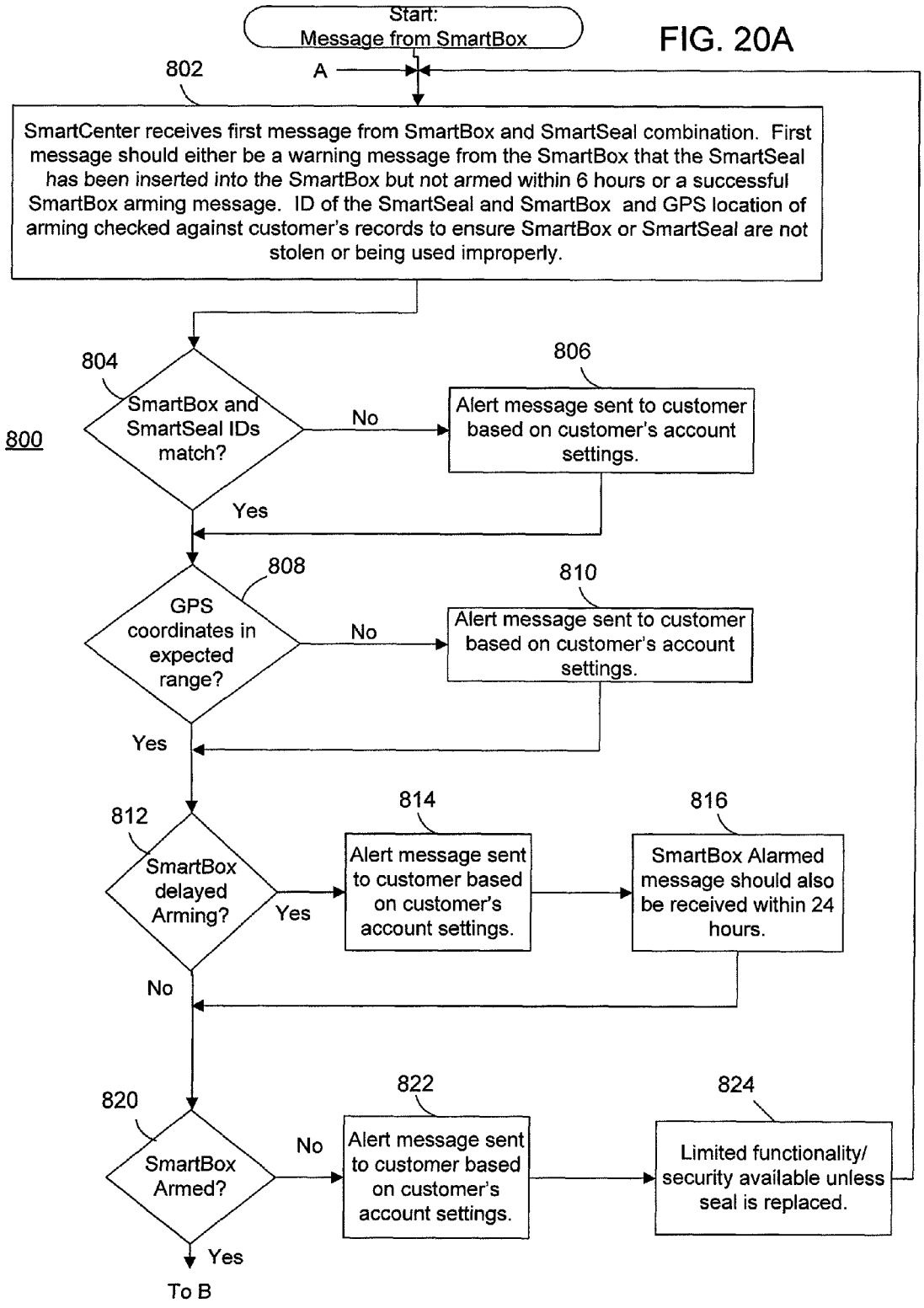
Start:
Message from SmartBox
FIG. 20A
A
802
SmartCenter receives first message from SmartBox and SmartSeal combination. First message should either be a warning message from the SmartBox that the SmartSeal has been inserted into the SmartBox but not armed within 6 hours or a successful SmartBox arming message. ID of the SmartSeal and SmartBox and GPS location of arming checked against customer's records to ensure SmartBox or SmartSeal are not stolen or being used improperly.
800
804
SmartBox and SmartSeal IDs match?
No
806
Alert message sent to customer based on customer's account settings.
Yes
808
GPS coordinates in expected range?
No
810
Alert message sent to customer based on customer's account settings.
Yes
812
SmartBox delayed Arming?
Yes
814
Alert message sent to customer based on customer's account settings.
816
SmartBox Alarmed message should also be received within 24 hours.
No
820
SmartBox Armed?
No
822
Alert message sent to customer based on customer's account settings.
824
Limited functionality/ security available unless seal is replaced.
Yes
To B

SHIPPING CONTAINER SEAL MONITORING DEVICE, SYSTEM AND METHOD

CROSS REFERENCE TO RELATED APPLICATIONS

This application claims priority to U.S. Provisional Application No. 60/855,090, filed Oct. 27, 2006, the entirety of which is incorporated herein by reference.

FIELD OF THE INVENTION

The present invention relates to monitoring shipping containers of the type used for worldwide containerized shipping and more particularly to a container seal device to retrofit to such containers. The present invention can also be applied to other types of shipping containers.

BACKGROUND

In the shipping industry, there is a need for security and logistics control to track shipping containers and other mobile assets worldwide. In particular, shipping containers are sealed at one location after they are loaded with cargo and then transported to another location where the cargo is unloaded. Shipping containers may also be subject to inspection by a Customs authority if the container is transported across country borders.

Concern for the safety of those involved in the shipping industry as well as the general public has resulting in a need for heightened security of shipping containers. The concern lies in whether a shipping container has been opened by an unauthorized party in order to take items from the container or place harmful items into the container. Thus, a solution is needed to track the status of shipping containers as well as determine whether the shipping container has been subjected to an unauthorized access or breach.

SUMMARY

Briefly, a container seal device is provided that comprises a seal device for a shipping container, comprising a first unit that is affixed to a shipping container. A control system is contained in the first unit. A second unit is provided that is configured to engage with an element of a door of a shipping container to which the first unit is affixed and to electrically connect with the control system in the first unit. The control system in the first unit is configured to detect a breach of the second unit indicative of access being made to the shipping container.

Objects and advantages of the present invention will become more readily apparent when reference is made to the following description taken in conjunction with the accompanying drawings.

BRIEF DESCRIPTION OF THE DRAWINGS

FIGS. 20A, 20B and 20C depict a flow chart that illustrates operation of a SmartCenter administration facility according to an embodiment.

DETAILED DESCRIPTION

Figure 1:
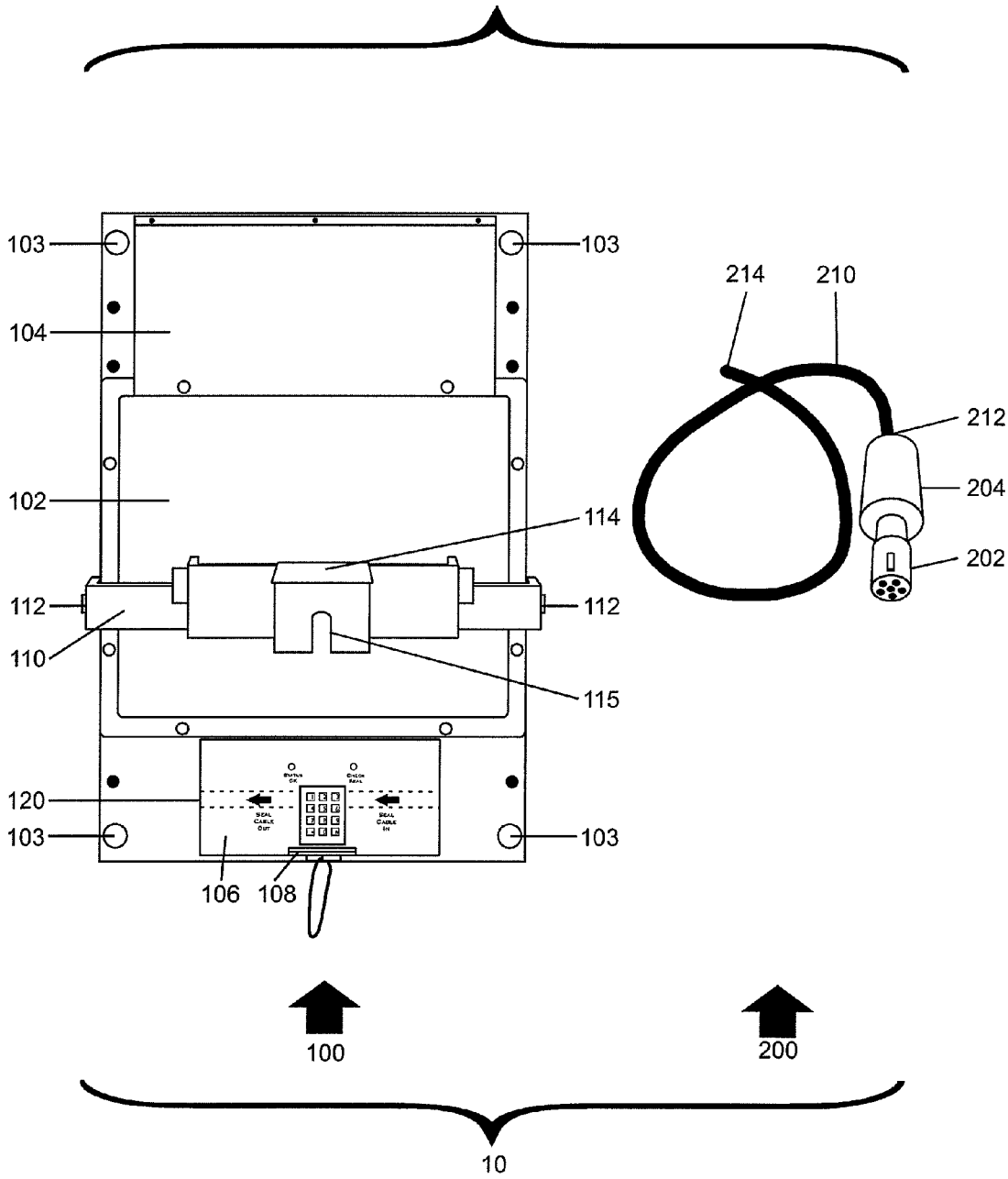
FIG. 1 illustrates a container seal system comprising a SmartBox unit and a SmartSeal unit according to an embodiment of the invention.

Referring first to FIG. 1, the container seal device according to the present invention is described. The container seal device is shown generally at reference numeral 10 and comprises a first unit 100, also called a SmartBox unit, housing unit or a control box unit that is attached to the door of a cargo container to be sealed and a second unit 200, also called a SmartSeal unit 200 or simply a seal unit. The SmartBox unit 100 serves as a means for housing a control system (as described hereinafter) and the SmartSeal Unit 200 serves as a means for engaging with an element of the door of a shipping container and for electrically connecting with the control system of the SmartBox unit 100.

The SmartBox unit 100 is contained in a housing that may comprise several housing portions: housing portion 102, housing portion 104 and housing portion 106. These housing portions are assembled together and attached to a cargo container door by, for example screws or bolts shown at 103. The housing portion 102 may contain antennas used by the SmartBox unit 100 for wirelessly communication. Thus, the housing portion 102 may be made of a strong plastic material that can protect the enclosed antennas from weather-related conditions. The housing portion 104 may be used as to secure the housing portion 102 to the container door in a secure manner. Housing portion 106 is a strong metal housing that contains the electronic components of the SmartBox control system, described in detail hereinafter. There are status indicators on the housing portion 106 as shown in FIG. 1 (and FIG. 3) and described in more detail hereinafter. In the housing portion 106 there is a SmartSeal unit connection port or receptacle pointing downward as shown at 108 that makes electrical connection with the SmartSeal unit 200 as described hereinafter.

There is a door member 110 that is connected at hinges 112 to the housing 102. The door member 110 has an protective cover 114 that extends outward and is designed to align beneath the connection port 108 when the door member 110 is rotated downward into a closed position as described hereinafter. There is a slot 115 in the protective cover 114 to allow the protective cover to fit over the connector plug of the SmartSeal unit 200 as will become apparent hereinafter. There are also bushings 116 in the arms of the door member 110 that permit passage of the cable of the SmartSeal unit 200, again as will become more apparent hereinafter.

Through the housing portion 106 there is a passageway 120 sized to receive a cable of the SmartSeal unit 200 as described hereinafter. There are holes on opposite faces of the housing portion that permit access to the passageway 120. The passageway 120 is configured to allow insertion of the cable of the SmartSeal unit 200 in one direction but prevents withdrawal or removal of the cable. In this sense, the passageway 120 is a one-way passageway that serves as a one-way latch on the SmartSeal unit 200 cable. When the door member 110 is rotated to a closed position, the bushings 116 align with holes on opposite faces of the housing portion 106 that provide access to the passageway 120. The passageway 120 is described in further detail hereinafter in connection with FIG. 2.

Still referring to FIG. 1, the SmartSeal unit 200 comprises an electrical plug connector 202, a housing unit 204 that contains components that make up a control system for the SmartSeal unit 200 as well as one or more batteries, and an elongated cable 210. The elongated cable 210 has a proximal end 212 that is connected into the housing unit 204 and a distal end 214 that is free. As described hereinafter, the elongated cable 210 contains one or more electrical conductors, one or more optical fibers and a steel cable for strength and resistance to cutting. The SmartSeal unit 200 may be a single or one-time use device as will become more apparent hereinafter. The cable 210 serves as an element, member or means to engage a portion of a door mechanism of a shipping container. It is only one example of an element or means to engage a portion of shipping container door mechanism. Other examples of such elements or means are described hereinafter.

The SmartBox unit 100 may be mounted to the outside of the container door to simplify electrical connection to the SmartSeal unit 200, or inside the container door. For examples, holes may be drilled into the container door or the SmartBox unit 100 may be welded to the container door.

Figure 2:
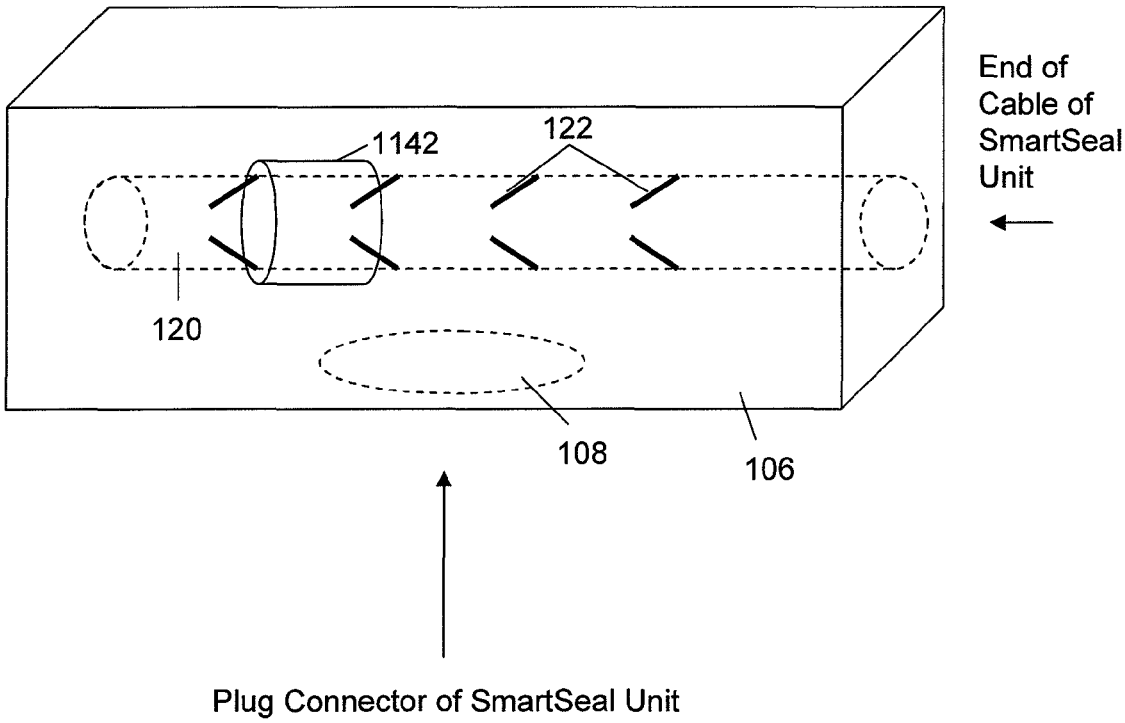
FIG. 2 illustrates an internal view of a portion of the SmartBox unit according to an embodiment.

Turning to FIG. 2, an internal view of the SmartBox unit 100 is shown behind the status panel 106. As shown in FIG. 2, the passageway 120 extends through a portion of the housing 102 that is behind the panel 106 and comprises clamp members 122. The clamp members 122 are positioned and biased to permit insertion of the distal end 214 of the cable 210 of the SmartSeal unit 200 from the right side through to the left side of the housing 102. The clamp members 122 prevent removal of the cable 210 of the SmartSeal unit 200 from the passageway 120 without cutting the cable 210 and thereby disarming the container seal device 10 as will become apparent hereinafter. FIG. 2 also shows the connector port 108 where the plug connector 202 of the SmartSeal unit 200 connects to the SmartBox unit 100 and a cable end detector module 1140 that detects the end of the cable of the SmartSeal unit 200 as described hereinafter in conjunction with FIG. 7.

Figure 3:
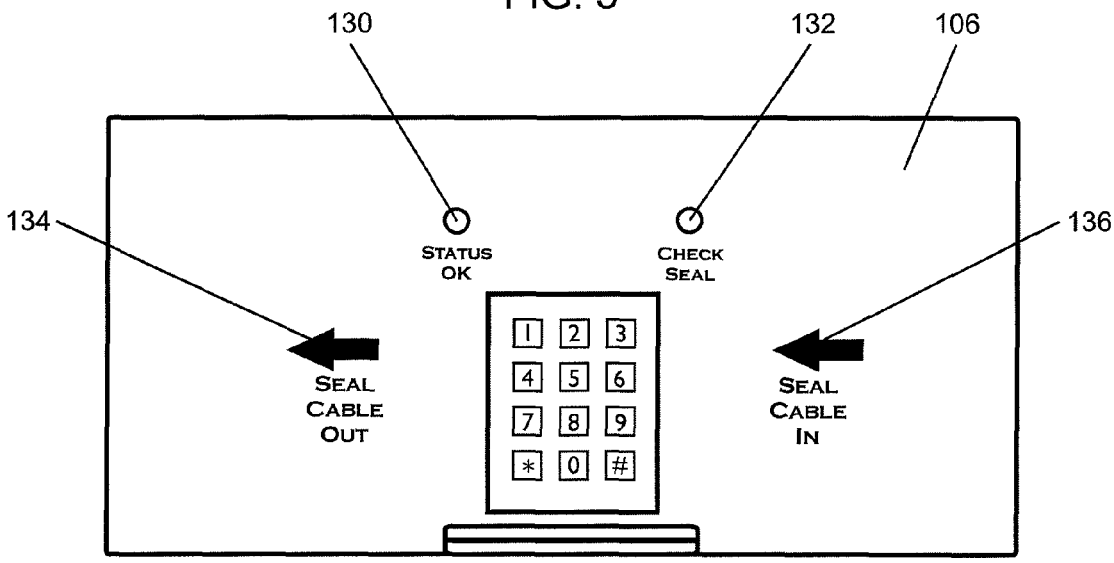
FIG. 3 illustrates a portion of the SmartBox unit that includes status indicators according to an embodiment.

Referring to FIG. 3, the status indicators on the housing portion 106 of the SmartBox unit 100 are further described. There are two visual indicators (e.g., light emitting diodes) 130 and 132 on the front face of the housing portion 106. The indicator 130 may have a first color, e.g., green and the indicator 132 may have a second color, e.g., red. The indicator 130 is illuminated (constant or blinking) to indicate normal status conditions of the container seal device 10 and the indicator 132 is illuminated (constant or blinking) to indicate a problem (e.g., bad seal, etc.) with the container seal device 10. The functions of the indicators 130 and 132 are described hereinafter in further detail. There are also textual and/or graphical elements 134 and 136 on the front face of the housing portion 106 to instruct or guide a user as to the direction to insert the distal end 214 of the cable 210 of the SmartSeal unit 200 into the passageway 120 of the SmartBox unit 100.

FIG. 3 also illustrates an optional keypad 138 on the housing portion 106 that may be used to enter identification numbers in order to arm and/or disarm the SmartBox unit 100. The keypad 138 is not a required component of the SmartBox unit 100, but may be useful for certain applications as described hereinafter.

Figure 4:
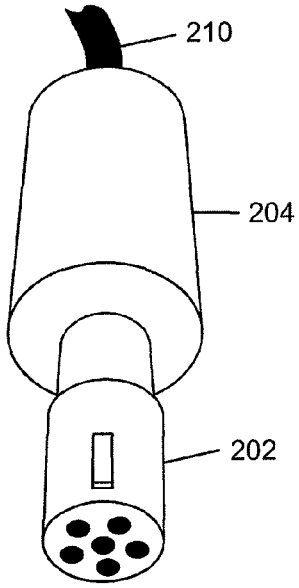
FIG. 4 is an end perspective view of a portion of the SmartSeal unit according to an embodiment.

Referring now to FIG. 4, the connector plug 202 and the housing unit 204 of the SmartSeal unit 200 are shown in more detail. The connector plug 202 may be any type of electrical connector that uses an industry standard (e.g., USB, PCI, Cardbus, etc.) or customized/proprietary connection technology. In the example shown in FIG. 4, the connector plug 202 is a standard 7-hole round plug. These holes will receive pins of the connection port 108 in the SmartBox unit 100 (FIGS. 1 and 3). It should be understood that the present invention is not limited to any particular connector structure.

The SmartBox Control System

Figure 5:
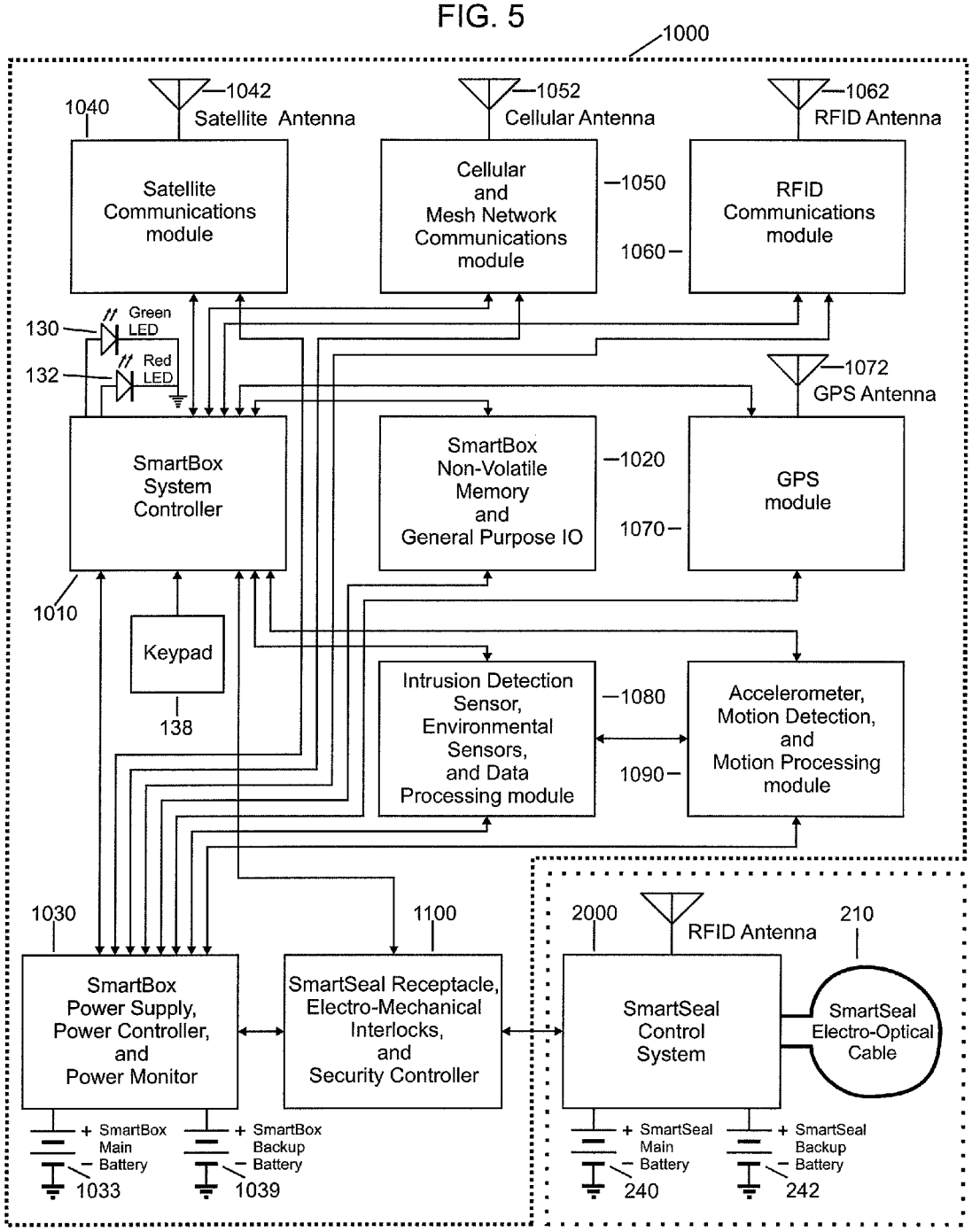
FIG. 5 is a block diagram of the SmartBox unit connected to a SmartSeal unit according to an embodiment.

Turning now to FIGS. 5, 6A, 6B and 7 functional block diagrams of the control device 1000 for the SmartBox unit 100 are described. As shown in FIG. 5, the SmartBox control device 1000 connects to the SmartSeal unit control system 2000 of the SmartSeal unit 200 via connector 202. While the foregoing description alludes to a plurality of different modules that form the control system 1000 of the SmartSeal unit 100, it should be understood that several or all of the various modules may be implemented on a single integrated circuit (IC) using "system on chip" semiconductor design and fabrication techniques now known or hereinafter developed. The same applies to the SmartSeal control system 2000, described hereinafter in conjunction with FIG. 8. In fact, such a single chip solution makes the electronics of the SmartBox unit 100 and SmartSeal unit 200 less expensive, more power efficient, and more secure from tampering.

The SmartBox control system 1000 comprises a system (main) controller 1010, a non-volatile memory and general purpose input/output (I/O) block 1020, and a power supply controller and monitor module 1030 associated with a main battery 1033 and a backup battery 1039. The system controller 1010 is a microprocessor or microcontroller (as available from Intel, Microchip or Motorola for example) that is programmed with software to perform the various SmartBox functions described herein. The non-volatile memory module 1020 comprises one or more memory devices (as available from Intel, Atmel or Microchip for example) to store various pieces of data, such as identifiers, status data, etc. The memory module 1020 stores one or more SmartBox identifiers, any special operating instructions for the SmartBox unit 100 as well as identification and status information received from a SmartSeal unit 200 connected to the SmartBox unit 100. The power supply controller and monitor module 1030 delivers power to all of the modules of the SmartBox control device 1010 as needed and manages other power conservation and consumption functions described herein. The batteries 1033 and 1039 may be any suitable (rechargeable or non-rechargeable battery), such as those available under the Eveready, Duracell or Rayovac brands. There are certain advantages that can be achieved when one or both of the batteries 1033 or 1039 is rechargeable, as described hereinafter. In addition, the batteries 1033 and 1039 may actually be embodied by a plurality of battery units to provide the required voltages and electrical capacities.

Status of the container seal device 10 is delivered via the visual indicators (LEDs) 130 and 132 by way of control signals generated by the system controller 1010. Any LED may be suitable for purposes of indicators 130 and 132 of the present invention, such as those available from Hewlett-Packard or Fairchild Semiconductor. The SmartBox unit 100 may have one or more communication capabilities and to this end the SmartBox control device 1000 may comprise a satellite communications module 1040 with an associated antenna 1042, a cellular and mesh network communications module 1050 and an associated antenna 1052, an radio frequency identifications (RFID) communications module 1060 and associated antenna 1062, and a global positioning systems (GPS) module 1070 and associated antenna 1072. For example, the GPS module 1070 is a GPS chip (or chipset) available from UBlox, Tremble, Motorola or Garmin, for example. Each of these modules is connected to the system controller 1010 to receive and transmit information. The RFID module 1060 may respond to requests from an RFID reader to transmit stored data representing the SmartBox identifier and/or a SmartSeal unit 200 identifier for the SmartSeal unit 200 connected to the SmartBox unit 100. The uses of these various communication modules are described in more detail hereinafter.

The GPS module 1070 allows the SmartBox unit 100 to tap into a satellite navigation system in order to determine its geographic location. GPS positioning may be performed in the SmartBox unit 100 even when the SmartBox unit is not armed with a SmartSeal unit 200. The cellular and mesh network communications module 1050 may have capabilities to communicate information over a wide-area communication protocol such as ReFLEX, the Blackberry two-way messaging system, GSM, or any other two-way wireless messaging or communication protocol now known or hereinafter developed. Thus, the GPS module 1070 serves as a means for determining a (geographical position) of the SmartBox unit 100, and the communications module 1050 serves as a means for wireless communicating information stored in the control system of the SmartBox unit 100 to a remote location. Direct user input to the SmartBox unit 100 may be provided by way of the keypad 138 that is connected to the system controller 1010.

The memory module 1020 stores GPS position, date and time information for the life of the SmartBox unit 100, in addition to the SmartBox identifier(s), SmartSeal unit 200 identifiers of an attached SmartSeal unit 200 unit and related SmartSeal unit 200 status information. The memory module 1020 may be encased in a steel ball which acts as a protective mechanism in case of vandalism or catastrophic damage to SmartBox control device 1000. Upon recovery of the steel ball, the data stored in the memory module 1020 can be retrieved.

There is an intrusion detection sensor, environmental sensors a data processing module 1080 that is connected to the system controller 1010 and an accelerometer motion detection and processing module 1090 also connected to the system controller. The module 1080 collects data from one or more container intrusion sensors (see FIG. 9) and processes the data produced by these sensors for analysis by the system controller 1010. Examples of container intrusion sensors are described in more detail hereinafter. The accelerometer motion detection and processing module 1090 comprises an accelerometer sensor and a processor that analyzes output of the accelerometer sensor to generate data indicative of whether and what type of motion the SmartBox unit 100 is subjected to. This data is supplied to the system controller 1010 for analysis. Finally, there is a SmartSeal unit 200 receptacle and security controller 1100 that manages communications of status and control signals to and from the SmartSeal unit 200.

The various antennas 1042, 1052, 1062 and 1072 shown in FIG. 5 make up what is referred to herein as an antenna module. The antenna module is mounted on the outside of the container or behind a non-conductive window so that the antennas are not totally enclosed by metal. The remaining components of the SmartBox control device 1000 may be mounted on either the inside or outside of the container. If mounted on the outside, these components may be combined with the antenna module into a single assembly. If mounted inside, these components are less vulnerable but an electrical connection with the antenna module needs to be made through the container shell or wall. A give-away locking nut may be used on the inside of the door. Also, if portions of the SmartBox control device 1000 are mounted inside the container, they may be packaged such that the resulting assembly can mount within a door corrugation because shippers depend on the exact inside container dimensions to be available for their goods. In either case, the components of the SmartBox control system (other than the antennas) may be suspended and protected by a non-conductive electronic potting material.

Conformal coating may applied to the circuit board(s) on which the various components of the SmartBox control device 1000 are mounted to seal the components and the circuit boards from moisture and temperature related complications or to create an electronic sealant.

As explained above in connection with FIG. 1, the antennas of the SmartBox control system may be mounted within a plastic casing designed to protect the enclosed antennas from weather-related conditions and industrial temperatures ranging from −40° C. to 85° C. The remaining components of the SmartBox control device 1000 may be placed inside the same casing, or within a separate casing or housing portion, e.g., housing portion 106. The antenna module casing 102 is sealed, airtight and waterproof.

Figure 6A:
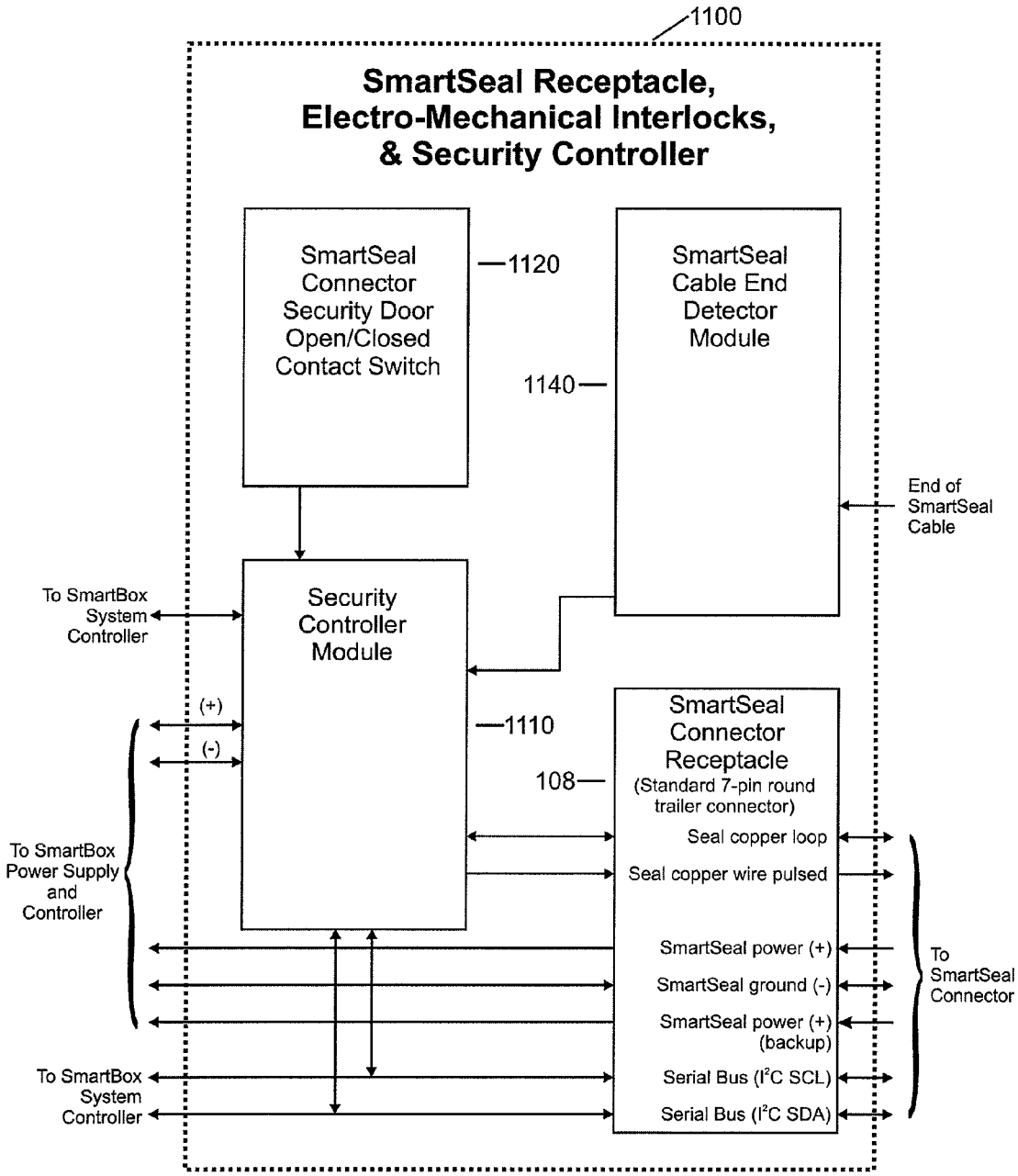
FIG. 6A is a block diagram of a receptacle and security controller module of the SmartBox unit according to an embodiment.

Turning to FIG. 6A, the SmartSeal unit 200 receptacle and security controller module 1100 of the SmartBox control device 100 is described in more detail. The module 1100 comprises a security controller 1110, a SmartSeal unit 200 connector security door open/close contact switch 1120, the SmartSeal unit connector receptacle 108 and a SmartSeal cable end detector 1140. The security controller 1110 is connected to a SmartSeal connector security door switch 1120, to the SmartSeal connector receptacle 108 and to the SmartSeal cable end detector 1140. The security controller 1110 determines whether a SmartSeal cable 210 is still in tact and whether the protective door 110 is closed based on the status of the switch 1120. The SmartSeal connector security door switch 1120 is a switch that is provided on the SmartBox unit 100 to monitor whether the door member 110 (FIG. 1) is in a closed position. The switch 1120 may be activated by a cam provided on one of the hinges 112 (FIG. 1).

The SmartSeal connector receptacle 108 is the same connection receptacle referred above in connection with FIG. 1. For example, the receptacle 108 may be a standard 7-pin round trailer connector. Two of the pins of receptacle 108 are used for the copper conductors of the SmartSeal cable 210 (SmartSeal unit loop out, SmartSeal unit loop in, SmartSeal unit wire pulsed) and three of the pins are used for supplying power to the SmartBox unit 100 (SmartBox power (+), SmartBox ground (−), SmartBox power (+) backup). The remaining 2 pins are used as a serial data bus to communicate with the SmartSeal unit 200 using a serial data communication standard such as $I^2C$.

The cable end detector 1140 may comprise a capacitively coupled voltage pickup device that surrounds the SmartSeal cable 210 when it is inserted through the one-way passageway 120 in the housing portion 106 of the SmartBox unit 100. The cable end detector module 1140 detects the presence (and absence) of the SmartSeal cable 210 in the SmartBox unit 100. Operation of the security controller 1110 and the cable end detector module 1140 are described in more detail hereinafter in conjunction with FIG. 8.

At time of manufacture, the SmartBox unit 100 is assigned a unique SmartBox identifier or address that is stored in the memory module 1020. This SmartBox identifier may be entered into a central database maintained at an administration facility, together with relevant container specification data, as described hereinafter. Proprietary or open software (or firmware) executed by the system controller 1010 provides the SmartBox unit with intelligence and logical interpretation capabilities. The software may process commands and execute algorithms based on whatever data is provided. The software will also execute algorithms to determine what actions are to be taken, such as best alternative communication method. For example, the system controller 1010, under control of the software, may determine the best alternative communication method available at the location of the SmartBox unit 100 and format data for transmission to an administration facility, as well as generate trip related unique identifiers (PINs). The software also prepares the SmartBox unit for downloading data into the SmartBox control device 1000 (such as configuration information and software updates) from the administration facility.

Upon installation of the SmartBox unit 100 to a cargo container or other asset to be tracked, the unique identifier of both the SmartBox unit 100 and a unique identifier of the asset are used to establish a relationship to one another. At this time, customer specific data may be loaded into the SmartBox unit 100 that is centrally managed by the administration facility. The SmartBox unit 100 may perform several self-monitoring tests throughout its life, such as power supply level checking, GPS position checking, real-time clock synchronization and two-way wireless communications checking. The SmartBox unit stores this and other data to its on-board non-volatile memory module 1020. This information is also transmitted to the administration facility for administration and end-user analysis. All data transmitted to or from the Smart Box unit 100 may be encrypted.

Figure 6B:
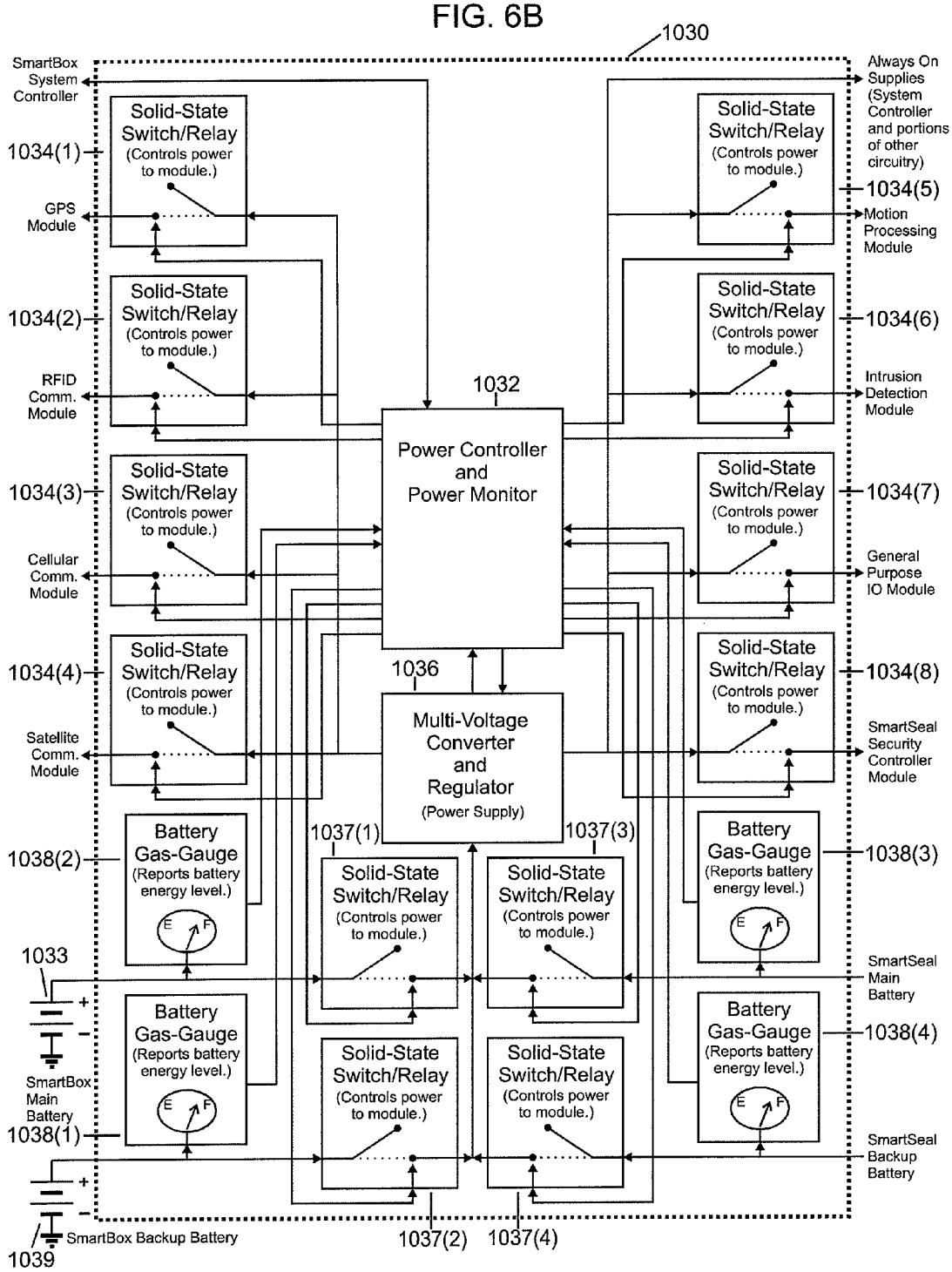
FIG. 6B is a block diagram of a power controller and monitor module of the SmartBox unit according to an embodiment.

Turning to FIG. 6B, the module 1030 is described in further detail. The module 1030 comprises a power controller and power monitor block 1032, a plurality of switches or relays 1034(1) to 1034(8) that control power to power consuming blocks in the SmartBox unit 100 or SmartSeal unit, a voltage converter and regulator 1036, a plurality switches or relays 1037(1) to 1037(4) that control which power source is used to supply power to the various power consuming blocks and a plurality of battery level detectors 1038(1) to 1038(4) that are used to monitor the power remaining in the batteries in the SmartBox unit 100 and SmartSeal unit 200.

The power controller and power monitor block 1032 supplies power status information to the SmartBox system controller 1010 and implements a power control algorithm under control of the SmartBox system controller 1010. The power controller and monitor 1032 receives power level inputs from the various level detectors 1038(1) to 1038(4) and also controls the voltage converter and regulator 1036 to generate the appropriate voltages needed by the various power consumer blocks. The power controller and monitor 1032 sends control signals, in response to commands from the SmartBox system controller 1010 to select ones of the switches 1034(1) to 1034(8) to supply power to the various power consumer blocks. Similarly, the power controller and monitor block 1032 is responsive to commands from the SmartBox system controller 1010 to determine which of the batteries (main or backup) of the SmartBox unit 100 and/or batteries (main or backup) of the SmartSeal unit 200 are used to supply power to a power consumer block at any particular time.

Figure 7:
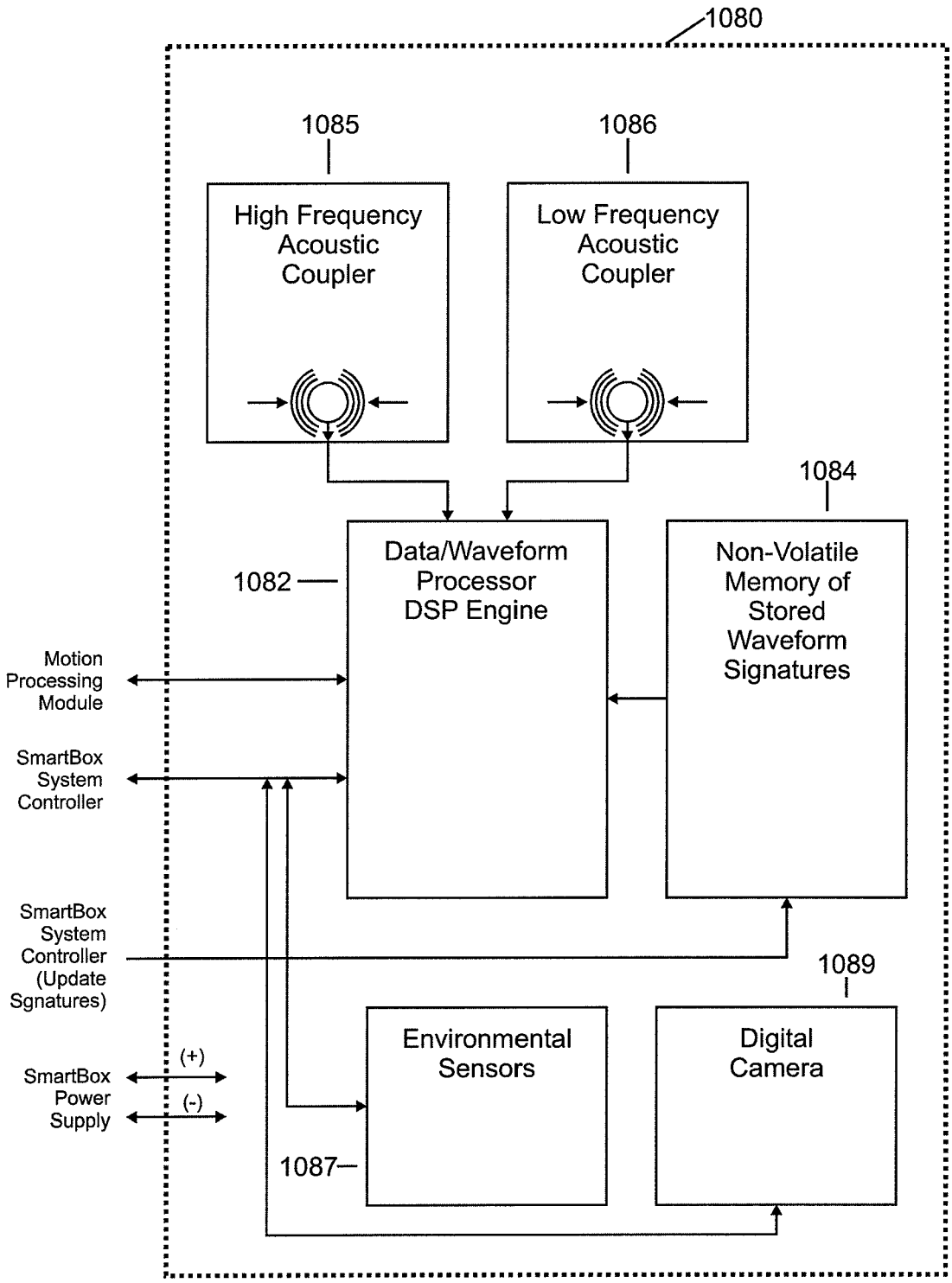
FIG. 7 is a block diagram of an intrusion sensor control module of the SmartBox unit according to an embodiment.

Turning to FIG. 7, the module 1080 of the SmartBox unit 100 is described. The module 1080 comprises a processor 1082, a memory 1084, acoustic (sensors) couplers 105 and 1086, and environmental sensors 1087. The acoustic coupler 1085 is a high frequency acoustic coupler that converts relatively high frequency vibrations and "noise" into electrical signals and supplies those signals to the processor 1082. The acoustic coupler 1086 is a low frequency acoustic coupler that converts relatively low frequency vibrations and "noise" into electrical signals and supplies those signals to the processor 1082. The acoustic couplers 1085 and 1086 may be mounted or otherwise acoustically coupled to a wall of the container on the inside or outside of the container. In fact, the simple presence of the acoustic couplers 1085 and 1086 in the SmartBox unit 100 itself may provide a sufficient coupling to the container wall. The acoustic couplers 1085 and 1086 are provided to determine whether there is a intrusion into the container. The memory 1084 stores signatures of noise sources for use by the processor 1082 in analyzing the signals supplied by the acoustic couplers 1085 and 1086. For example, the memory 1084 may store signatures of drilling, sawing, air hammering, chains banging, impact, etc., that are indicative of a potential intrusion into the container. The processor 1082 analyzes the signals supplied by the acoustic couplers 1085 and 1086 to determine or identify the sources of detected vibrations by comparing the waveforms of those signals against the library of stored signatures. In this way, the processor 1082 may determine if a detected vibration or noise source is acceptable or problematic, i.e., indicative of an intrusion into the container. When analyzing these signals, the processor 1082 may take into account motion of the container (on a truck, ship, etc.) based on information supplied to the processor 1082 from the module 1090. Under some circumstances, the processor 1082 may assist the module 1090 in determining the type of motion to which the SmartBox unit 100 is subjected.

In addition, there are other environmental sensors 1087 that may be provided as part of the module 1080 and connected to the processor 1082. For example, environmental sensors may include temperature sensors, pressure sensors, light sensors (inside the container), etc. Further still, the module 1080 may include a digital camera 1089 that is controlled by the system controller 1010. The digital camera 1089 may be positioned on the SmartBox unit 100 in a location that can capture photographic images (and/or audio) of a person that is arming and/or disarming the SmartBox unit 100, as well as of a person who is tampering with the SmartBox unit 100 or the container door itself. The image data captured by the digital camera 1089 is supplied to the system controller 1010 for storage in the memory 1020 and optionally for transmission to the SmartCenter facility. Photographs are useful in criminal investigations. The digital camera 1089 may be an inexpensive wide-angle electronic camera, of the type used in cell phones, and aimed so as to photograph persons sealing the container or breaking the SmartSeal unit 200. Said another way, the digital camera is positioned in the SmartBox unit 100 so as to capture images of a person attempting access into the container through the container door or interacting with (attempting operation or tampering of) the SmartBox unit 100 or SmartSeal unit 200 much like the recording camera used in banking automated teller machines (ATMs).

The functions of the intrusion sensor module 1080 as part of the SmartBox unit 100 are described in more detail hereinafter.

The SmartSeal Control System

Figure 8:
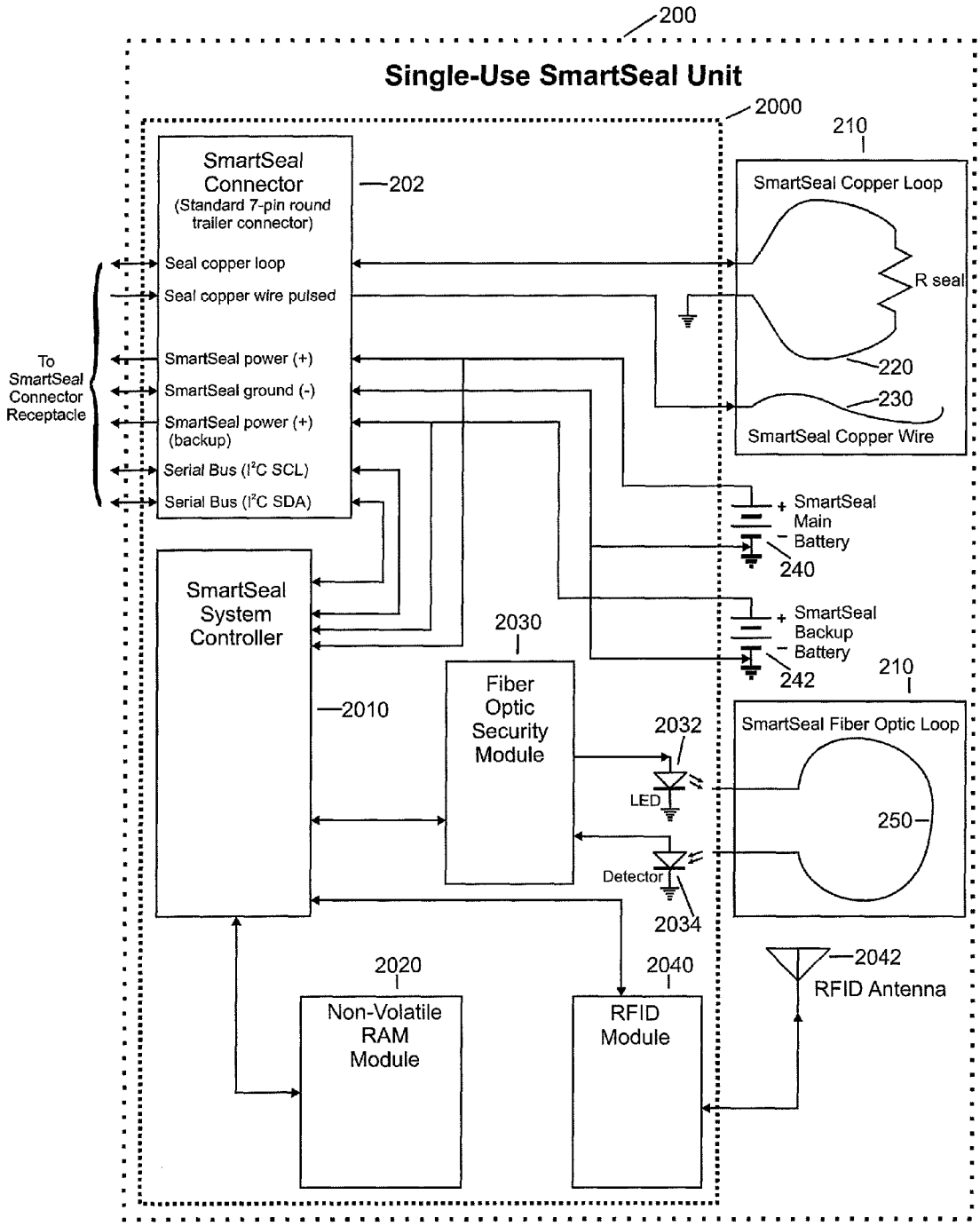
FIG. 8 is a block diagram of the SmartSeal unit according to an embodiment.

Turning now to FIG. 8 (with reference to FIG. 6A as well), a functional block diagram for the SmartSeal control system 2000 is now described. The SmartSeal control system 2000 comprises the SmartSeal connector plug 202, a SmartSeal system controller 2010, a non-volatile random access memory (RAM) module 2020, a fiber optic security module 2030 and a RFID module 2040. The SmartSeal connector plug 202 is complementary to the SmartSeal unit connector receptacle 108 shown in FIG. 5 to make electrical connection to the SmartBox unit 100. The connector 202 is connected to a copper wire loop 220 contained in the SmartSeal cable 210 having an effective resistance Rseal, to a SmartSeal copper wire 230 also contained in the SmartSeal cable 210, to a main battery 240 and to a backup battery 242.

The SmartSeal system controller 2010 is connected to the connector 202, to the non-volatile RAM module 2020, fiber optic security module 2030 and RFID module 2040. The SmartSeal system controller 2010 communicates with the SmartBox system controller 1010 over the $I^2C$ serial data bus referred to above. The SmartSeal system controller 2010 uploads to the SmartBox system controller 1010 a SmartSeal identifier (stored in the RAM module 2020), data indicating the status of the SmartSeal unit 200 (e.g., status of the SmartSeal cable 210, etc.), and any other special instructions that have been programmed into the RAM module 2020. Conversely, the SmartSeal system controller 2010 downloads from the SmartBox system controller 1010 a SmartBox identifier(s) (stored in the memory 1020 of the SmartBox control device 1000) and other SmartBox status information supplied by the SmartBox controller 1010. This downloaded information from the SmartBox control device 1000 may be stored in the RAM 2020. The SmartSeal system controller 2010 also controls the power to the modules of the SmartSeal control system 2000 so that the modules are powered either from the main battery 240 or the backup battery 242.

The RAM module 2020 stores the SmartSeal unit 200 identifier(s) that is/are assigned to the SmartSeal unit 200, the downloaded information from the SmartBox control device 1000, the SmartSeal unit 200 status information and any special operating instructions that have been programmed into the SmartSeal unit 200 unit 100.

The fiber optic security module 2030 is a circuit that is connected to a light source, e.g., an LED, 2032 and to a photodetector or photosensor 2034. The light source 2032 is coupled to one end of a fiber optic loop 250 that is contained in the SmartSeal unit 200 cable 210. The fiber optic security module 2030 generates control signals to cause the light source 2032 generate a pattern of light pulses that travel through the fiber optic loop 250 and are detected by the photodetector 2034. The fiber optic security module 2030 can detect if the fiber optic loop is broken or breached by analyzing the output of the detector 2034 to determine whether or not the detector 2034 continues to detect the pattern of light pulses supplied by the light source 2032 at the other end of the loop 250.

A primary function of the seal mechanism of this SmartSeal unit is to detect breaches of its physical SmartSeal unit 200 component, whether authorized or unauthorized, and transmit an alarm by radio. A record of the breach is also placed in non-volatile memory within the SmartBox unit 100.

The device 10 was created to address some concerns associated with other electronic seals/system. One significant issue with other seal systems is false positives where the seal/system triggers a breach message for some reason and the seal was actually mechanically not breached. The second scenario is the opposite where a real breach occurs and the seal/system does not report the problem probably because the seal security was too easily bypassed. For cable systems, a very common failure occurs when the cable is chafed by one of the sharp edges during container transport that leads to failures of both types, but more commonly generates false positives.

According to one example implementation, the device SmartSeal unit 200 may have three independent seal breach tests.

The copper loop 220 is, for example, a twisted copper pair similar to that used in a CAT5 wire used for computer networking. In this twisted pair configuration, the pair of wires of the loop 220 has a characteristic resistance/impedance that can be easily measured when pulsing the pair of wires. Cutting the pair of wires of the loop 220 creates an 'open' electrical condition but also changes the impedance Rseal of the loop 220. Therefore, if someone or something attempts to 'alligator clip' two wire sections (created by cutting the loop 220) back together, it would be almost impossible to get the impedance back to its original (and known) value. Thus, the twisted pair of wires of the loop 220 offer a high degree of tamper proof reliability. The security controller 1110 in the SmartBox unit checks for an 'open' condition as well as a measure of the impedance of the twisted copper pair of loop 220. The SmartBox unit 100 directly monitors the characteristics of the twisted pair copper loop 220 done so even if the electronics in the SmartSeal unit 200 is somehow damaged, the integrity of the SmartSeal unit can be verified. The SmartBox unit also checks the single strand of copper wire 230. Thus, there are two verifiable ways to check the integrity of the SmartSeal unit 200 even if the SmartSeal unit electronics are completely inoperable. Furthermore, the SmartBox unit 100 checks for the insertion of the SmartSeal unit 200 by checking both the change in battery levels from the SmartSeal battery gas gauges (FIG. 7) and by a change in impedance on the copper loop pin of the connector receptacle 202. In this way, the SmartBox unit 100 can determine that there is a SmartSeal unit 100 inserted even if the batteries of the SmartSeal unit 100 are somehow completely dead.

The single copper wire 230 runs as a single wire through substantially the entire length of the cable 210. The security controller 1110 generates a unique time-varying pulse train (at a relatively a small voltage) that is applied to the wire 230 so that the wire 230 acts like a broadcast antenna to broadcast the pulse train ultimately for detection by the SmartSeal cable end detector module 1140. After the SmartSeal connector 202 is inserted into the receptacle 108 of the SmartBox unit 100 and the end 214 of the cable 210 has been put through the one-way security passage latch 120 of the SmartBox unit 100, the capacitive/voltage pickup of the cable end detector module 1140 should detect the time varying pulse train sent through the wire 230 to ensure that arming of the SmartBox unit 100 is completed and that the wire connected into the SmartBox unit 100 at the SmartSeal connector 108 is the same wire that is in the cable 210 that passes through the one way secure latch 120 because this would only be the case if the pulse train detected by the cable end detector 1140 is substantially the same as the pulse train applied to the wire 230 by the security controller module 110. Using a single wire consumes less power when pulsed than the twisted pair, but a single wire can be cut and patched with an alligator clip. Therefore, the security controller 1110 also supplies a pulse train at a slower rate to the twisted pair wire of loop 220 since a twisted pair cannot be easily bypassed. The capacitive voltage pickup device of the cable end detector 1140 will also detect the pulses through the twisted pair wire of loop 220. As a further variation, the single wire 230 may be used as an antenna that is referenced against the twisted pair wire of loop 220. Further still, the single wire 220 may be configured to be a backup/covert antenna for the cellular and RFID communications modules of the SmartBox unit 100.

As described above, cable end detector module 1140 is provided to ensure that the cable 210 plugged into the SmartSeal connector 108 of a SmartSeal unit 200 is the same cable that is pushed through the one-way secure latch 120 of the SmartBox unit 100. Otherwise, if a simple device such as a switch on the latch determines if something was merely pushed through the latch, any piece of cable could be pushed through the one way latch and there would be no way for the SmartBox unit 100 to verify that the cable pushed through the one way latch was indeed the right SmartSeal cable. Thus, the cable end detector module 1140 checks to make sure the 'loop' is closed. Also, because the pattern pulsed on the copper wires varies with time, there is no way to mimic of fake that same pattern with a different seal or some other form of pattern generator. The security controller 1110 in the SmartBox unit 100 compares the pattern sent out on the copper wires to the pattern received by the cable end detector module 1140 and the two patterns should be substantially the same, otherwise an alert is generated indicating that a possible breach condition has occurred.

As one example, the cable end detector module 1140 may be a conductive tube in which the cable 210 is inserted. The voltage pulsed onto the wire 230 is capacitively coupled to the conductive tube. A field effect transistor (FET) may be connected to the conductive tube to pickup the modulated voltage (pulse train) and to set an interrupt to the security controller module 1110. Another example is to use a coil rather than a conductive tube. Referring back to FIG. 2, the conductive tube or coil is shown at reference numeral 1142 arranged around the passage 120.

Where there are multiple means of detecting a breach (such as the wire and optical fiber described above), whether in the physical SmartSeal unit 200 or from container intrusion sensors their respective alarm signals may either be ORed together for high security or ANDed together to minimize false alarms, or the choice may programmed into the SmartBox unit 100.

In general, detecting a SmartSeal unit 200 breach with light or electrical interruption involves the continual expenditure of battery power. Another, entirely mechanical, approach involves pressurizing a shackle. A shackle is ideally a hardened steel bolt, manufactured to be hollow and filled with very high pressure air, and sealed. Any attempt to grind, cut, or break the shackle will release the pressure. The presence of pressure is monitored without expending electrical power as follows. A pressure-release valve on the end of the bolt is inserted into the SmartBox unit 100, not unlike the valve on an automobile tire. The pressure is so high that the valve will not open even under the force of a spring-loaded pin in the SmartBox unit 100. When the bolt is cut, however, the pressure is released and the spring-loaded pin can then move, actuating electrical contacts which wake up the SmartBox unit 100. Unlike a tire valve, the valve contemplated here would be used only once and hence could be manufactured for zero leakage.

The RFID module 2040 may have active RFID capabilities in order to transmit status information of the SmartSeal unit 200 unit and/or associated SmartBox unit (including SmartSeal unit 200 and SmartBox identifier(s)), as well as receive instructions from an RFID reader device. There is an RFID antenna 2042 connected to the RFID module 2040. As an example, the RFID module 2040 and antenna 2042 (as well as the RFID module 1060 and antenna 1062 in the SmartBox control device 1000) may be embodied in a single chip or chipset solution, such as those available from Sokyman and other similar RFID chip manufacturers. Furthermore, the RFID module 2040 may read whether or not the SmartSeal unit 200 is connected to the SmartBox unit 100.

The SmartBox unit 100 acts as a docking base for the SmartSeal unit 200. The SmartSeal unit 200 mechanism of this invention is inserted into a receptacle integral with the SmartBox unit 100. The battery power supply 240 in the SmartSeal unit 200 may recharge the batteries 1033 and/or 1039 in the SmartBox unit 100 when the SmartSeal unit 200 is connected to the SmartBox unit 100. Furthermore, the battery power supply 240 in the SmartSeal unit 100 may serve as the primary power source of the SmartBox unit 100 as well once the device 10 is armed, and until such time that the SmartSeal unit 200 is removed from the SmartBox unit 100. The SmartBox unit 100 and the SmartSeal unit 200 may communicate with each other on a continuous basis and perform checks such as resistance continuity checking and SmartSeal unit 200 integrity.

In one embodiment, the SmartBox unit 100/SmartSeal unit 200 unit (when connected to each other) may initiate the generation of two secret PINs using a random number generator process executed by the SmartBox system controller 1010. One PIN may be assigned to Customs authorities for cargo inspection purposes. The other PIN may be assigned to owner or agent of cargo in the corresponding container; this PIN would be used to engage the release (disarm) function of the SmartSeal unit 200. The PINs may be electronically and randomly generated and kept confidential. They would be sent only to the owner/agent of the cargo and can be used to issue a controlled authorized release of goods once they have received payment and/or upon arrival of cargo to the appropriate GPS coordinates.

The SmartSeal unit 200 physically activates the SmartBox unit 100. As explained above, each SmartSeal unit 200 has a unique identifier stored in it that is read by the SmartBox unit 100 during the seal arming process. There may be different types of categories of SmartSeal units 200, wherein each type of SmartSeal unit 200 performs specific functions and may be distinguished from other types of SmartSeal units by a color-coding scheme. The RAM module 2020 in the SmartSeal unit 200 stores data that identifies the type of SmartSeal unit 200 and the various functions which that type of SmartSeal unit 200 is programmed to perform at the time of manufacturing. For example, the four different types of SmartSeal units are as: (1) Shipping; (2) Empty Container; (3) Customs; and (5) Test.

The Shipping type SmartSeal unit may have a yellow coloring on a portion thereof and is configured to provide immediate notification of power-up, breach and authorized openings of the associated container. The Test type of SmartSeal unit may have a blue coloring on a portion thereof and is configured to perform diagnostic checks of the SmartBox unit 100 and to confirm a successful test by flashing the Status Ok LED on SmartBox unit 100. The Customs type SmartSeal unit may have a red coloring on a portion thereof and is configured to allow re-sealing of a container after inspection by Customs authorities. The Empty Container SmartSeal unit may have a green color on a portion thereof and is configured to allow for an empty cargo container to be monitored while sitting idle or in motion.

Further, the SmartSeal unit 200 may have multiple identifiers. A first identifier is fixed and visible on the SmartSeal unit 200 and a second identifier the other is electronic (stored in the SmartSeal unit) and kept confidential. Other identifiers may be randomly generated for use by Customs authorities and in which case only the Customs authority have access to these identifiers.

An auxiliary locking mechanism may optionally be provided. This locking mechanism may comprise a steel bar locking device that secures the container door from unauthorized openings by controlling the spring-loaded release mechanically, based on customer's configured instructions. This locking mechanism is located inside of the back of the container door. In order to deactivate this device, one would need to be in the container to release the inner locking mechanism. The SmartBox unit 100 provides the signal to release the auxiliary locking mechanism.

One consideration is providing power to the SmartBox unit 100, which is permanently or temporarily attached to a container, over the estimated eight-year life of the container. There are several potential sources of power for the SmartBox unit 100. The preferred solution involves using multiple ones of these sources according to the container's environment and the ever-changing state of the art in battery technology. Examples of sources are non-rechargeable batteries in the SmartBox unit 100 with eight-year shelf lives; rechargeable batteries in the SmartBox unit 100 recharged by fresh batteries in each disposable SmartSeal unit 200, a solar panel on or near the SmartBox unit 100 similar to those used on a calculator, power system of the ship, truck, crane or train transporting the container and/or a generator in the SmartBox unit 100 powered by the swaying and rocking motions imparted to the container by the ship, truck, crane or train transporting the container, similar to a "self-winding watch". With regard to "the self-winding watch" power recharging concept, it is noted that a container is not making money when it is stationary and therefore containers are in motion most of the time.

When the term "battery" is used in the singular herein, it is to be understood that multiple commercially battery units may actually be provided and connected in series, parallel, or through electronics (e.g. voltage regulator) in a given design. All battery units may not be the same type in order to achieve performance specifications not available from any single type. For example, the SmartSeal unit 200 may use four AA alkaline batteries and one AA Lithium battery. One battery type is capable of high peak power, whereas the other has higher total energy storage.

Still another consideration regarding power is conservation. Except for possible pressurization/evacuation of the container, the largest consumer of power is outgoing radio communication, particularly to a satellite communication system. Other communication modalities require less power. Thus, in one embodiment, the SmartBox unit 100 makes an intelligent selection of the communication modality. At any given time one or more modes may be unusable due to transmission conditions. The SmartBox unit 100 tries each communication modality in increasing order of power, but may alter that order based on additional knowledge. For example, when the container is at sea cellular telephone communications is unlikely to work. Using GPS information, the SmartBox unit 100 can reasonably estimate what modalities will be usable. Additionally, information may be downloaded to the SmartBox unit 100 to aid in the determination. In the hold of a ship, a local radio relay (if available) may be the only working modality. Further still, in the situation where there are multiple relatively closely located SmartBox units on containers, the SmartBox units may be operable as a so-called mesh network, where a SmartBox on one container exchanges information with a SmartBox on another container, and so on, until a path out to a useful communications modality is found.

Tamper sensors and GPS positioning are also consumers of power. The need for these activities varies with environment. For example, at sea the container is safest and thus the intrusion sensing functions and GPS fixes can be infrequent. Conversely, the container is least safe when it is parked in an isolated area. One important invention herein is the use of an accelerometer module 1090 in the SmartBox unit 100 for multiple purposes. The accelerometer module 1090 can identify when the SmartBox (attached to a container) is absolutely stationary, whereas the rocking motions of boats, trucks, or trains each have unique acceleration signatures identifiable by data processing. The accelerometer module 1090 can also identify unauthorized moving of the container in a yard or dropping of the container.

In addition to GPS positioning, there are terrestrial means to provide or aid in location fixes, such as LORAN and WAAS and the SmartBox unit 100 may utilize these services if and as appropriate.

As is known in the art, radio communications is only as good as the antenna(s) used to transmit and receive signals. The SmartBox unit may employ multiple communication modalities, including but not limited to GPS, WAAS, LORAN, cellular radio, paging, two-way satellite, mesh networks, and local radio relay, as described above. The optimum antenna for each of these modalities is, in general, different. One option is to use separate commercially available antenna assemblies for each modality as shown in FIG. 5. These antenna assemblies may include preamplifiers or other electronics associated with the antenna function. Alternatively, various antennas may share components and elements and be optimized for their environment. For example, the SmartSeal cable 210 (or a rigid bolt) may be used as an antenna or backup antenna for at least one communication modality.

Container Intrusion Sensors

Figure 9:
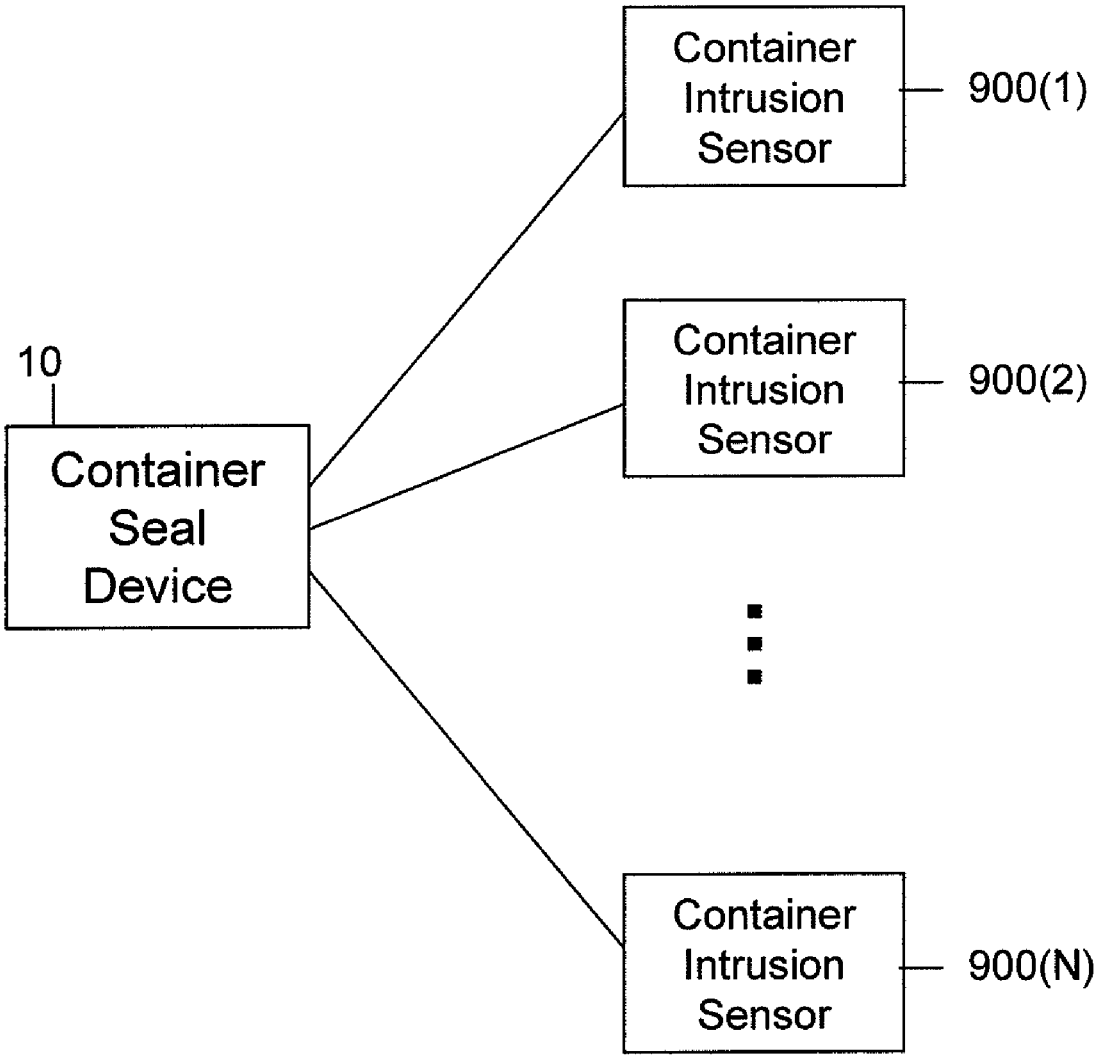
FIG. 9 is a block diagram showing the container seal system connected to one or more container intrusion sensor according to an embodiment.

Turning to FIG. 9, a further embodiment of the invention is described. As explained above in connection with FIG. 7, the SmartBox unit 100 may receive input from sensors mounted on or in the container to monitor for intrusions into the container. FIG. 9 more generally shows how any one or more of a plurality of intrusion container sensors 900(1) to 900(N) may be coupled to the container seal monitoring device 10 (SmartBox/SmartSeal combination) to monitor for intrusion of the container. The sensors 900(1)-900(N) may be positioned to face inside the container to detect one or more of distance, temperature, humidity, biological hazards, nuclear radiation hazards, pressure, weight, acoustic energy (i.e., the acoustic couplers 1085 and 1086 shown in FIG. 7), light (using photodetectors), impact (i.e., using the acoustic couplers 1085 and 1086), etc. A number of sensory devices may be used for scintillation purposes when appropriate.

The sensors may also detect for an unacceptable condition that is not necessarily an intrusion per se. Examples of unacceptable conditions include, without limitation, the presence of a designated chemical substance (e.g. an explosive), excess temperature, or radioactivity within the container or an indication the container has been dropped.

Yet another adverse event is a breach of the container at a point other than its normal SmartSeal unit 200, for example, by sawing or melting an unauthorized access hole into the container. Detection of unauthorized access holes is expected to be government mandated. Detecting unauthorized access holes may be achieved as follows:

Detection of unauthorized access holes by means of light. Shipping containers are typically light-tight except for the vents. If the vents are replaced with special light-excluding vents, the inside of the container becomes pitch-black. Highly sensitive semiconductor light sensors (photodiodes) are available that could detect such conditions. One or more such sensors would be mounted on the SmartBox unit 100 facing inward to the interior of the container. Light from the sun, moonlight, a streetlight, or small flashlight would render even a small hole detectable. Furthermore, the sensitivity spectrum of the photodiode could include the illuminators (infrared) of night-vision apparatus.

Detection of unauthorized access holes by means of conducted sound. Sawing, drilling, grinding, or even cutting torches create loud sounds carried throughout the container shell or wall are detected by one or both of the acoustic couplers 1085 and 1086 processed to detect vibrations indicative of a breach into the container. Miscellaneous objects, such as chains, normally hit container walls creating loud sounds in the shell. However the sounds they produce are of short duration compared to what is needed to make a hole. It is duration that would be the major discriminator against false alarms in the processor of the module 1080 in the SmartBox unit 100.

Detection of unauthorized access holes by means of pressure changes. The inside of the container is maintained at a slight vacuum, e.g. 0.1 PSI below atmospheric pressure. A slight negative pressure can be maintained more easily than a positive one because container doors open outward and a negative pressure would therefore hold them tightly closed. Any attempt to make a hole in the container, even a relatively small one, will release the vacuum and trip a pressure-sensing alarm. This scheme involves modification to the container to prevent leakage. The container vents are replaced with vents that freely vent overpressure but do not vent underpressure until an underpressure threshold, for example 0.15 PSI, is reached. Containers currently have water-tight seals around the doors. Those seals are replaced with a more expensive air-tight seals that can withstand small dents without leaking. A pump within or controlled by the SmartBox unit 100 maintains the vacuum. Surprisingly little energy is required to do this, energy that can be supplied by battery. For example, lowering the pressure of a 40'×8'×8' container by 0.1 PSI requires removing only 17 cubic feet of air from the container at an energy cost of 170 Joules (ignoring pump inefficiency). One high-capacity D battery is rated at 80,000 Joules. How often this must be done depends on residual leakage and ambient temperature fluctuations.

The most likely time for tampering of the container is not on shipboard or in container docks or yards which are heavily guarded and monitored, and increasingly so. The greatest danger is when a container is at a remote location on land. One defense against this is the SmartBox unit 100 history log of GPS location, time, seal/unseal event with photographic imaging, unusual acceleration event, etc. This log maintained in the memory of the SmartBox and uploaded to the SmartCenter facility. The SmartCenter facility may also interrogate the SmartBox unit 100, instruct it to change its behavior (e.g., take more frequent GPS fixes in a suspicious location) and download software updates to it.

Figure 10:
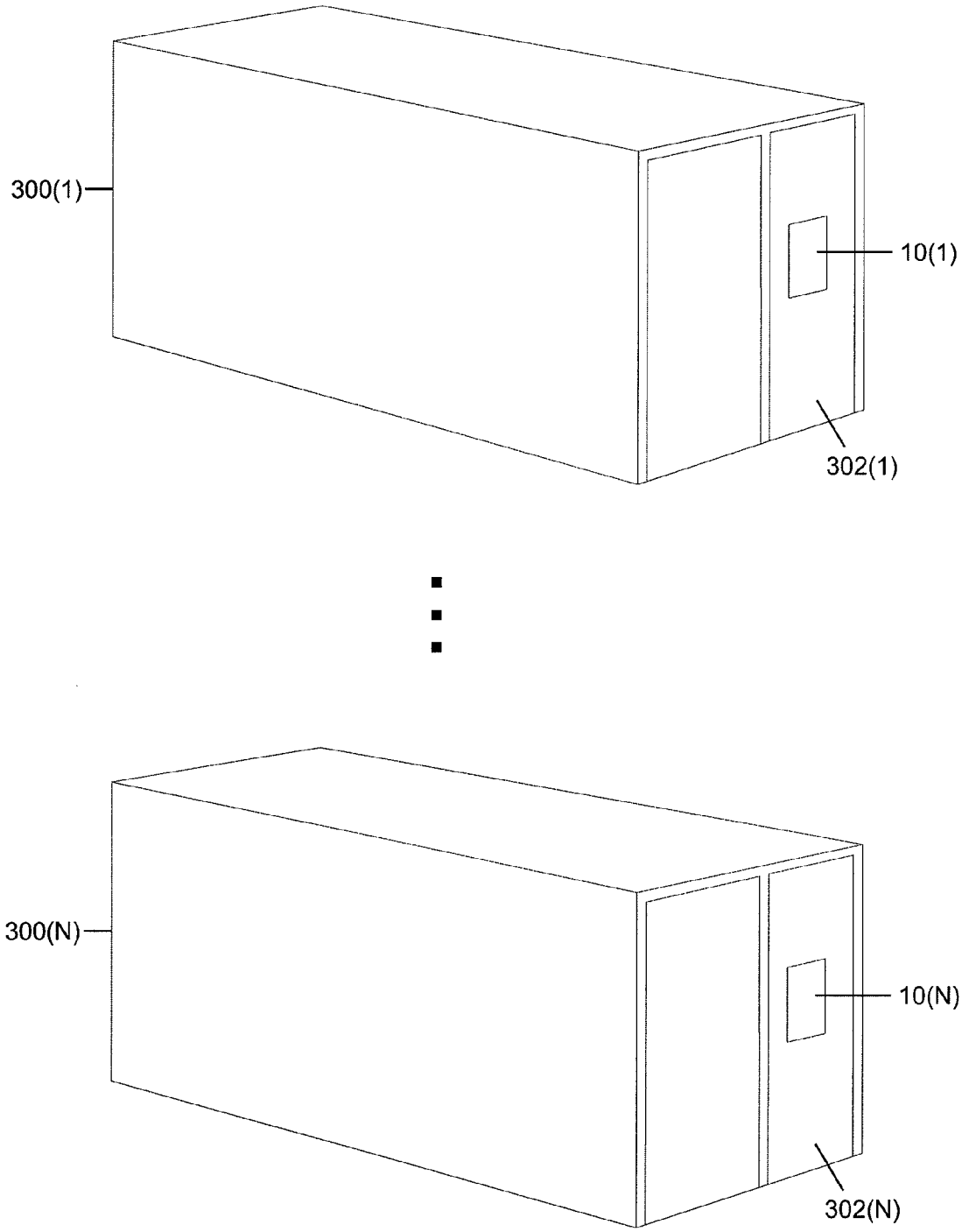
FIG. 10 is a diagram showing multiple shipping containers to which a container seal system is attached according to an embodiment.

FIG. 10 illustrates how the container seal device 10 is deployed for use according to an embodiment of the present invention. FIG. 10 shows a plurality of cargo containers 300(1) to 300(N). Each cargo container 300(1) to 300(N) has a door 302 that permits access to the contents of the container. The container seal device 10 is deployed on the outside wall of the (e.g., right) container door 302. The SmartBox 100 is on the right door since the left door cannot be opened unless the right door is opened first. Mechanically, there are two plates welded to the left side of the right door that extend over the left door which prevent the left door from being opened unless the right door has opened a certain amount, e.g., 8-10 inches. Thus, one instance of the container seal system shown at 10(1) is deployed on container 300(1), and so on, up to an Nth instance of the container seal system shown at 10(N) on container 300(N). Each instance of the container seal system comprises a SmartBox unit 100 affixed (either permanently or temporarily) to the outside of a wall of a container and a SmartSeal unit 200. The containers 300(1) to 300(N) may be transported on a transport vehicle (e.g., boat, plane, train, truck, etc.) together or separately. There are certain operational features of the container seal device 10 that can be achieved when there are multiple container seal systems 10(1) to 10(N) in proximity to each other as will be described hereinafter.

Figure 11:
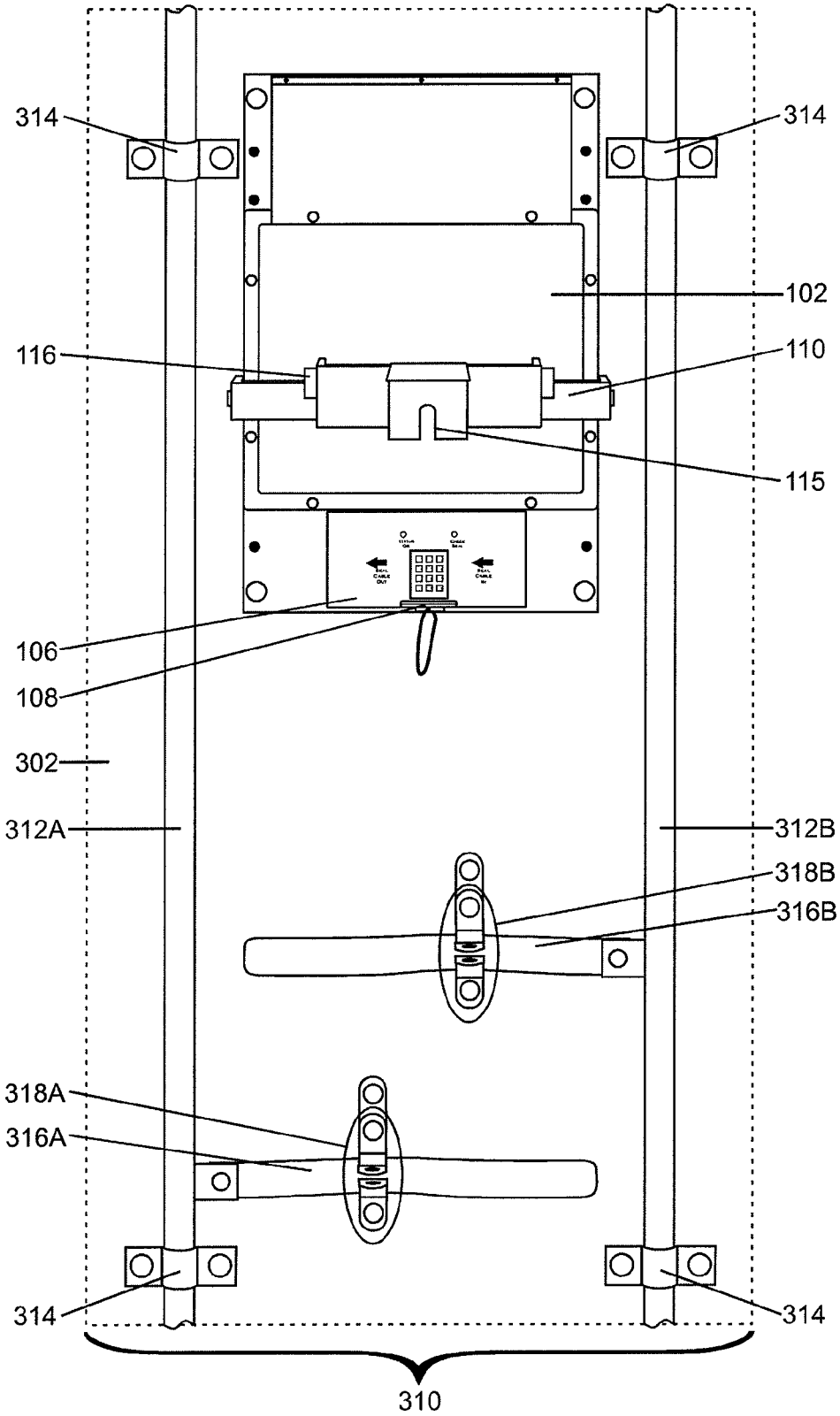
FIGS. 11-14 are diagrams illustrating installation and arming of a SmartBox unit with a SmartSeal unit according to an embodiment.

Referring now to FIGS. 11-14, the physical steps of arming the container seal device 10 according to the embodiments of the present invention are now described. FIG. 11 shows that the SmartBox unit 100 is bolted to the outside of a container door wall 302 of a cargo container. It should be understood that the SmartBox unit 100 may be attached in other ways, such as by welding, screws, etc., and the mounting mechanism may permanently or temporarily (readily removable, but still secure) attach the SmartBox unit to the container door. The SmartBox unit 100 may be mounted at a position on the container door wall 302 between the door handle mechanism 310 comprising elongated bars 312A and 312B that pass through hinge brackets 314. There are door handles 316A and 316B connected to elongated bars 312A and 312B, respectively. Door handle 316A is used to rotate the elongated bar 312A and door handle 316B is used to rotate the elongated bar 312B, and in so doing the container door 302 is opened (or closed). There is a hasp pair (loops or rings) 318A associated with door handle 316A and hasp pair 318B associated with door handle 316B. When the container door 302 is in a closed position as shown in FIG. 11, the hasps in each hasp pair is aligned with each other. In FIG. 11, the SmartBox unit 100 is ready to be armed. The door member 110 is opened, allowing access to the connection port 108 on the SmartBox unit 100.

Figure 12:
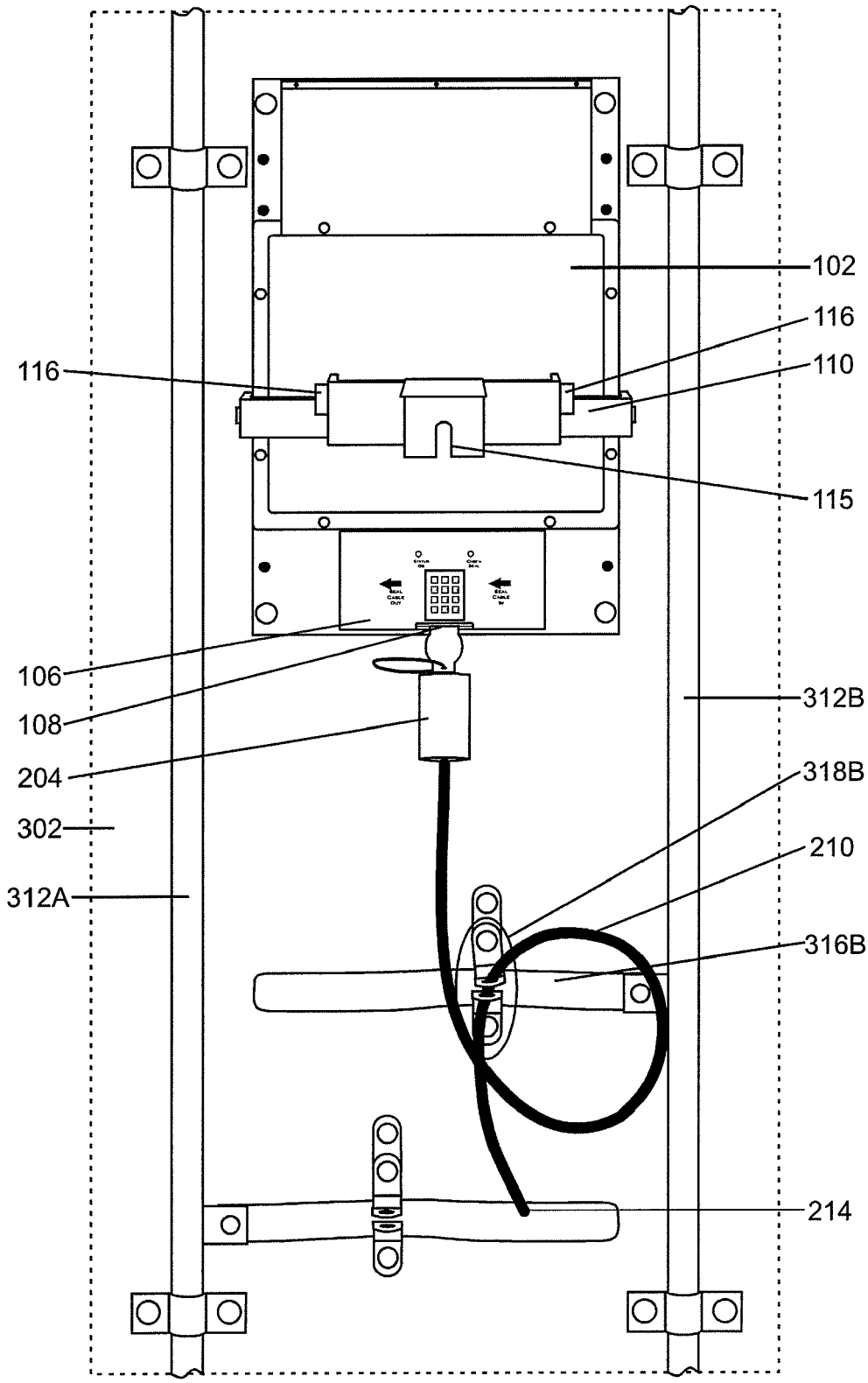

Referring now to FIG. 12, with the container door 302 in the closed position, connector plug 202 of the SmartSeal unit 200 is inserted into the connection port 108 of the SmartBox unit 100 to establish an electrical connection between the SmartSeal unit 200 and the SmartBox 100. Next, the distal end 214 of the cable 210 is inserted through the hasps of the hasp pair 318B associated with door handle 316B.

Figure 13:
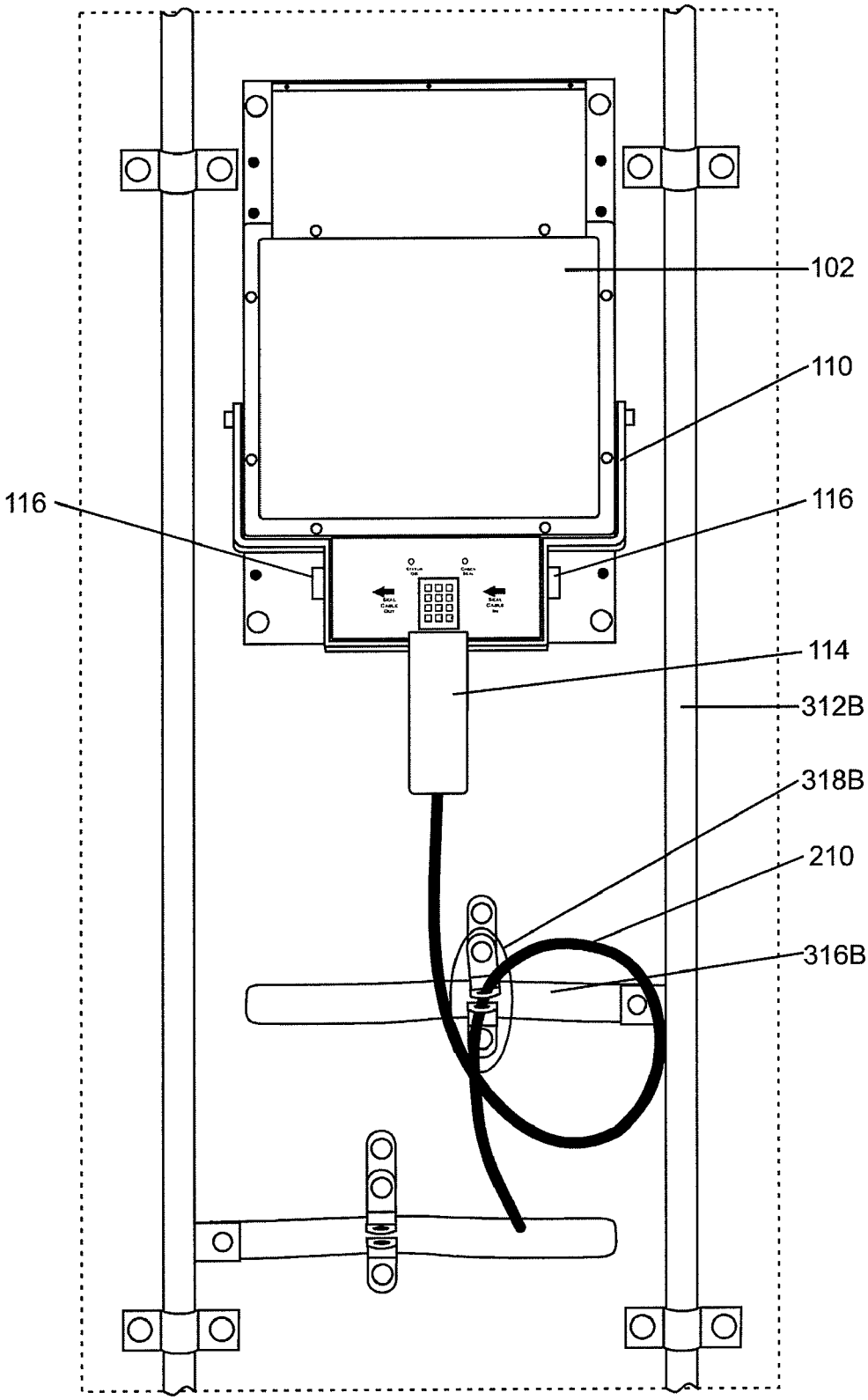

Turning to FIG. 13, next the door member 110 of the SmartBox unit 100 is rotated downward to a closed position so that the protective cover 114 covers the housing unit 204 and connector plug 202 of the SmartSeal unit 200. In the closed position, the bushings 116 on the arms of the door member 110 are aligned with holes on opposite sides of the housing 102 that provide access to the passageway 120. The SmartBox unit 200 is now ready to receive the cable 210 of the SmartSeal unit 200.

Figure 14:
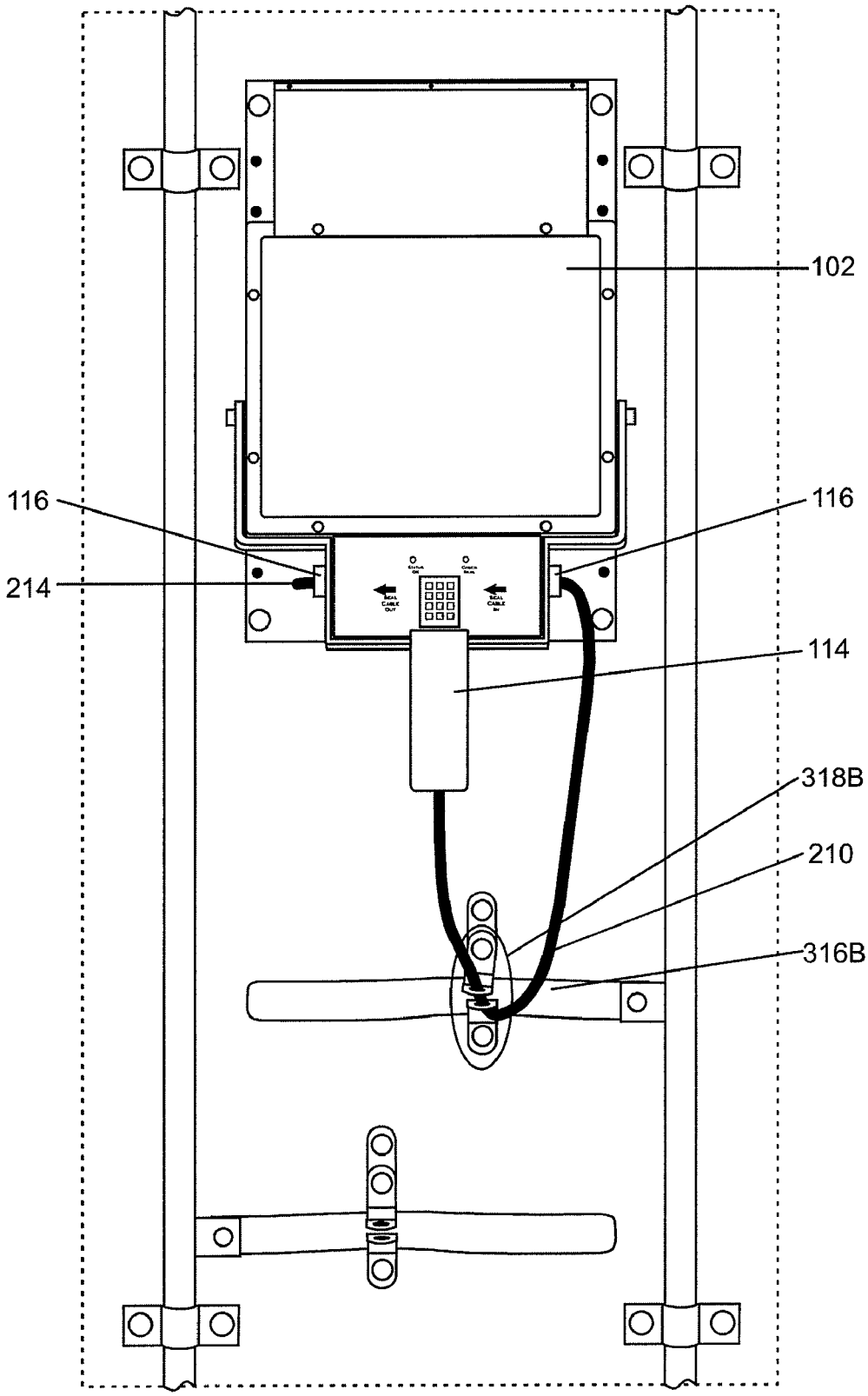

Moving now to FIG. 14, the distal end 214 of the cable 210 is inserted through the bushing 116 on the right arm of the door member 110 and into a hole on the right side of the housing 102. The cable 210 is pushed through the passageway until it comes out through the hole on the left side of the housing 102 and through the bushing 116 on the left arm of the door member 110. The cable 210 cannot be pulled out of the SmartBox unit 100 without cutting it. That is, the cable 210 can be pulled further to the left through the passageway 120 of the SmartBox unit 100, but cannot be pulled to the right out of the SmartBox unit 100. Thus, at this point, if other conditions permit as described hereinafter, the container seal device 10 is armed. The container door 302 cannot be opened without rotating the door handle 316B which would cause the cable 210 to be physically compromised or broken, causing the container seal device 10 to generate an alert as described further hereinafter. The one-way passageway 120 in the housing 102 will grip the cable 210 of the SmartSeal unit 200 unit and thereby prevent the door handle 316B from being opened. In addition, the door member 110 cannot be lifted and rotated to an open position because the cable 210 passes through the bushings 116 on the arms of the door member 110. Thus, if any of these operations are attempted with enough force, the cable 210 will break and the SmartBox unit 100 will detect that event and generate an alarm.

When a container 300 to which the container seal device 10 is deployed reaches its destination, or is inspected by a customs official, the container door 302 is opened by cutting the cable 210, pulling one section of the cable 210 out of the container door hasps 318B and the remaining section of the cable 210 out of one-way passageway 120 of the SmartBox unit. The door 302 may then be opened, door member 110 opened (rotated upward) thereby raising the protective cover 114 to remove and discard the remainder of disposable cable 210.

Container Tracking and Monitoring

Figure 15:
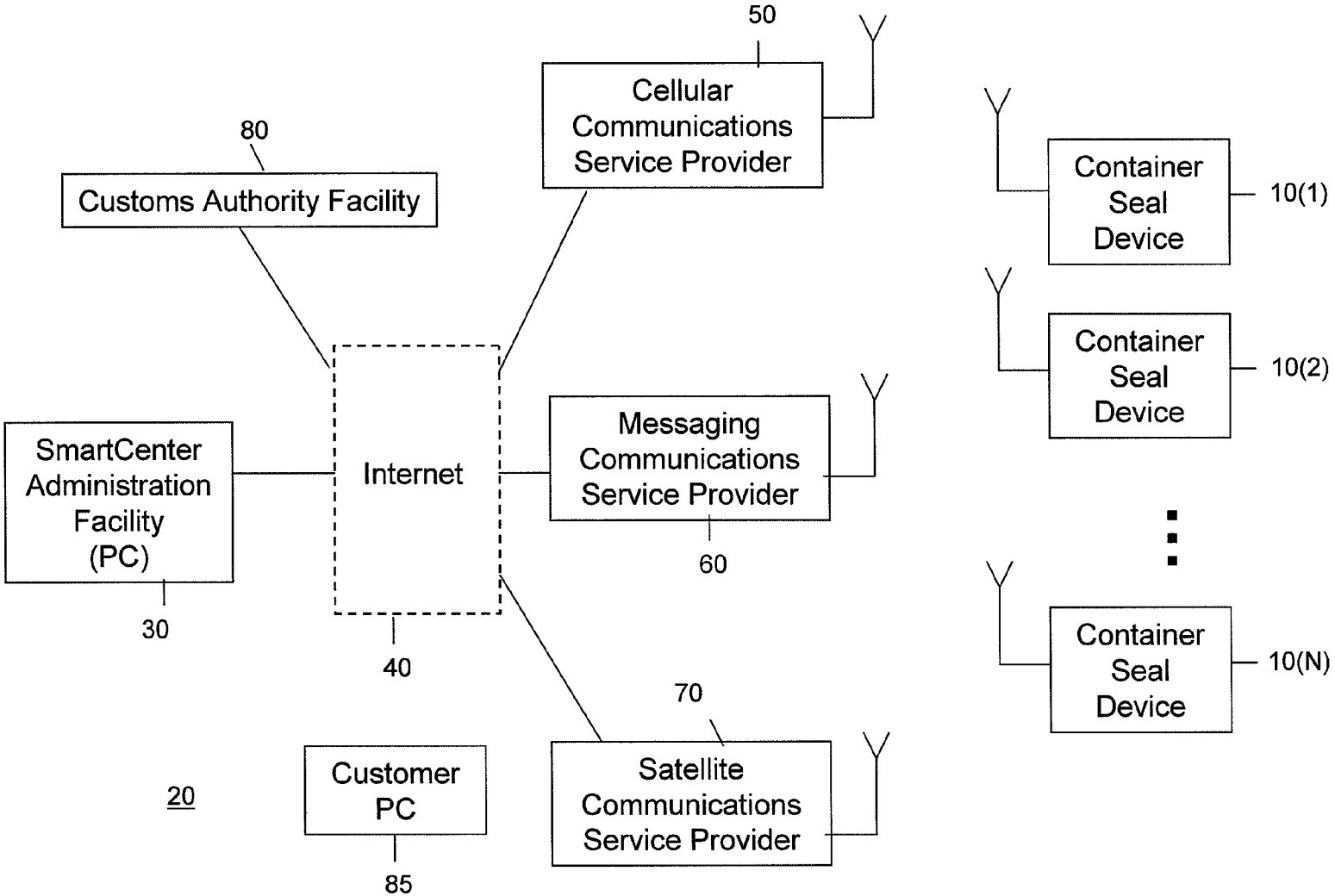
FIG. 15 illustrates a block diagram of a monitoring system that includes a SmartCenter administration facility and one or more container seal devices according to embodiments of the present invention.

Turning to FIG. 15, a cargo container monitoring and tracking system 20 is shown which employs one or several container seal systems 10(1) to 10(N), each for a corresponding cargo container. A SmartCenter administration facility 30 is provided that communicates with the container seal devices 10(1) to 10(N). The SmartCenter administration facility may comprise a computer, such as a personal computer (PC) or server computer and generally it is at a remote location from the container seal devices 10(1) to 10(N). Indeed, the SmartCenter facility 30 may be located any place where there is connectivity to the Internet. The SmartCenter facility 30 connects to the Internet 40 through any suitable network interface (not shown). Also connected to the Internet 40 are routing servers for one or more of cellular communications service provider 50, two-way messaging communication service provider 60 (e.g., Blackberry™ or other comparable two-way email or messaging services) and satellite communications service provider 70. The SmartCenter facility 30 may communicate with the container seal monitoring systems 10(1) to 10(N) through any one or more of the wireless communication services shown in FIG. 15, or any other suitable wireless communication service now known or hereinafter developed. In addition, a customs authority facility (PC or server computer) 80 may communicate with data tracked by the SmartCenter administration facility 30 or directly with container seal systems 10(1) to 10(N).

The SmartCenter facility 30 executes a container monitoring software application that may be, in one embodiment, a web-based application. The container monitoring software allows an authorized end user to view, configure and analyze tracking and security components and store and/or retrieve this information from a central database. Using this application, an end-user can perform the functions including: purchasing hardware components, managing company information, setting up users and assigning them a function/security access level, tracking assets in containers, viewing security status of assets, generating reports, building customized reports, building notification lists for breach and event triggered actions, assigning a broker or insurance agent, and submitting technical support questions. This software application may be designed with standard interfaces for customer use (where appropriate), and application use to interface with other software packages for security, encryption or mapping purposes.

In one embodiment, customers may log onto a website maintained by the SmartCenter facility 30 to gain controlled access to information pertaining to the customer's shipping containers. This is shown in FIG. 15 where a customer at a PC may log into a website maintained by the SmartCenter facility in order to access data pertaining to shipping containers that are being tracked by the SmartCenter facility. In this way, a customer may authorize the SmartCenter facility to send a command to a container seal device to disarm the device and thereby permit authorized access to one of the customer's shipping containers. Alternatively, the customer may select parameters under which the SmartCenter or the SmartBox itself will automatically disarm a container seal device, such as when the container seal device reports that it has been transported to a certain geographical location, etc.

As indicated above, the central monitoring software of the administration facility 30 stores data concerning cargo containers and their associated container seal systems in a central database. The central database may be a relational database that houses various tables of information containing tracking, security, user and company configured information. Tables may be related to one another using standard database techniques depending on the relationship—one to one, or one to many. Indexes, triggers and other standard database techniques may be used to partition data in such a way that customers will only see their own data. That is, the SmartCenter facility 30 stores data containing identifiers of the SmartBox units 100 and SmartSeal units 200, and user party identifiers (customer identifiers) that are associated with certain SmartBox units and SmartSeal units.

Examples of data related to cargo and container seal systems that may be monitored, tracked and stored by the SmartCenter facility 30 include security status, GPS position, time and date, acceleration profiles, radioactive and nuclear matter integrity in real-time, etc.

Figure 16A:
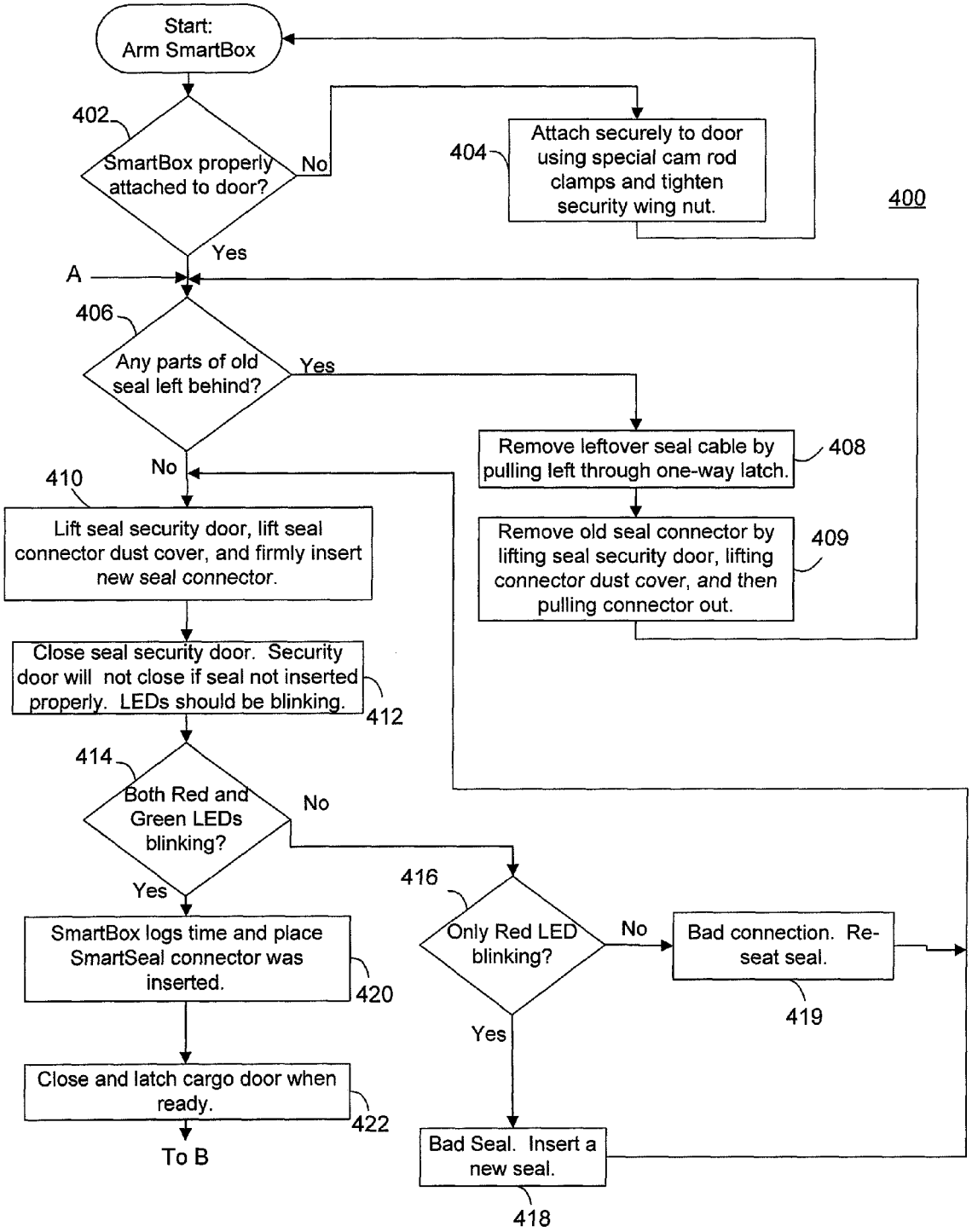
FIGS. 16A and 16B depict a flow chart that illustrates steps for arming a SmartBox unit according to an embodiment.
Figure 16B:
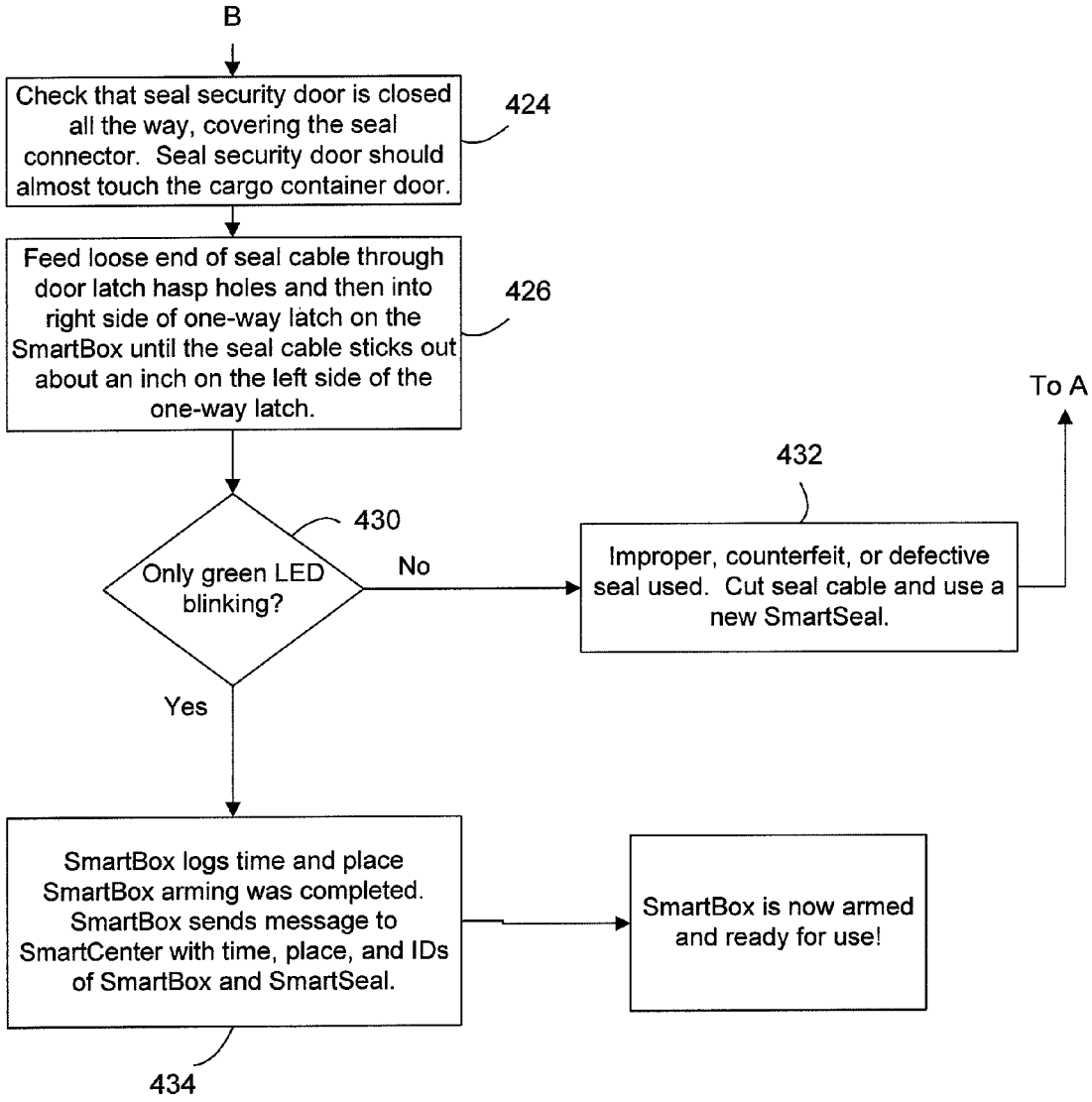

With reference to the flow chart of FIGS. 16A and 16B, arming procedure 400 of the container seal device 10 is described. Some of the operations shown in FIGS. 16A and 16B are performed by a user and others are performed by the SmartBox system controller 1010 shown in FIG. 5. At 402 and 404, the SmartBox unit 100 is attached to a door of a cargo container as described above in connection with FIG. 11, if the SmartBox unit 100 is not already attached to the container door. At 406, a user determines whether there are parts of a previously used SmartSeal unit 200 left behind in the SmartBox unit 100. If so, then these parts are removed as indicated at 408 and 409. Once any old SmartSeal unit parts are removed (if any), then at 410 a user lifts the protective door member 110 (FIGS. 1 and 11) and inserts the connector 202 of a SmartSeal unit 200 into the SmartSeal connector of the SmartBox unit 100. The user then closes the protective (security) door 110 at 412. The protective door 110 will not close if the SmartSeal unit is not inserted properly. On the other hand, if the SmartSeal unit is inserted properly, the visual indicators 130 and 132 will both be blinking. At 414, if a user determines that both visual indicators 130 and 132 are not blinking, then the process proceeds to 416 and 418 to resolve whether the cause is a bad SmartSeal unit 200 or a bad connection of the SmartSeal unit 200 into the SmartBox unit 200.

Once a user determines that both visual indicators 130 and 132 are blinking, then at 420, the SmartBox system controller in the SmartBox unit 100 logs the time that, and position (e.g., GPS position) where, the SmartSeal unit 200 was inserted. At this point, at 422 a user may close and latch the cargo container door when ready to seal the cargo container. At 424, the user checks the SmartBox unit 100 to be sure the protective door 110 is completely closed and then at 426 the user feeds the free end of the SmartSeal cable 210 through the door latch hasp holes and then into the right hole into the one-way passageway (latch) 120 in the SmartBox unit 100 until the cable 210 sticks out a certain distance from the left hole of the one-way passageway 120.

At 430, the user determines whether only the visual indicator 130 is blinking. If so, then the SmartBox system controller in the SmartBox unit 100 logs the time and place associated with completion of the arming process. The SmartBox unit 100 transmits a message to the SmartCenter facility indicating the time and place associated with arming completion and the identifiers of the SmartBox unit 100 and SmartSeal unit 200 inserted therein. If at 430 the user determines that the visual indicator 130 is not blinking, then the SmartSeal unit is determined to be defective, counterfeit or otherwise improper and the cable 210 is cut and the process repeated from 406.

Figure 17B:
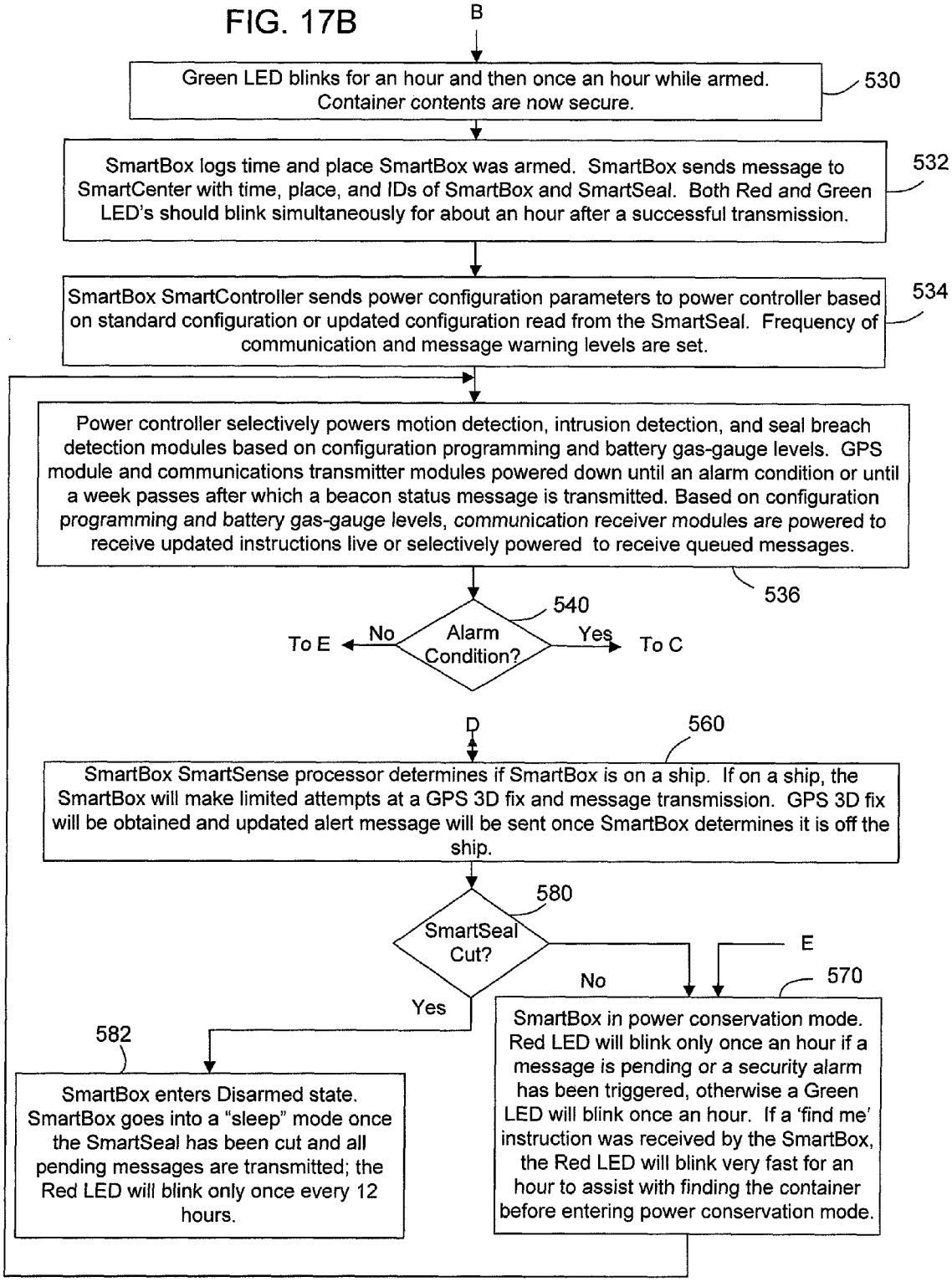
FIGS. 17A, 17B and 17B depict a flow chart that illustrates operation of a SmartBox unit when in an armed state according to an embodiment.
Figure 17C:
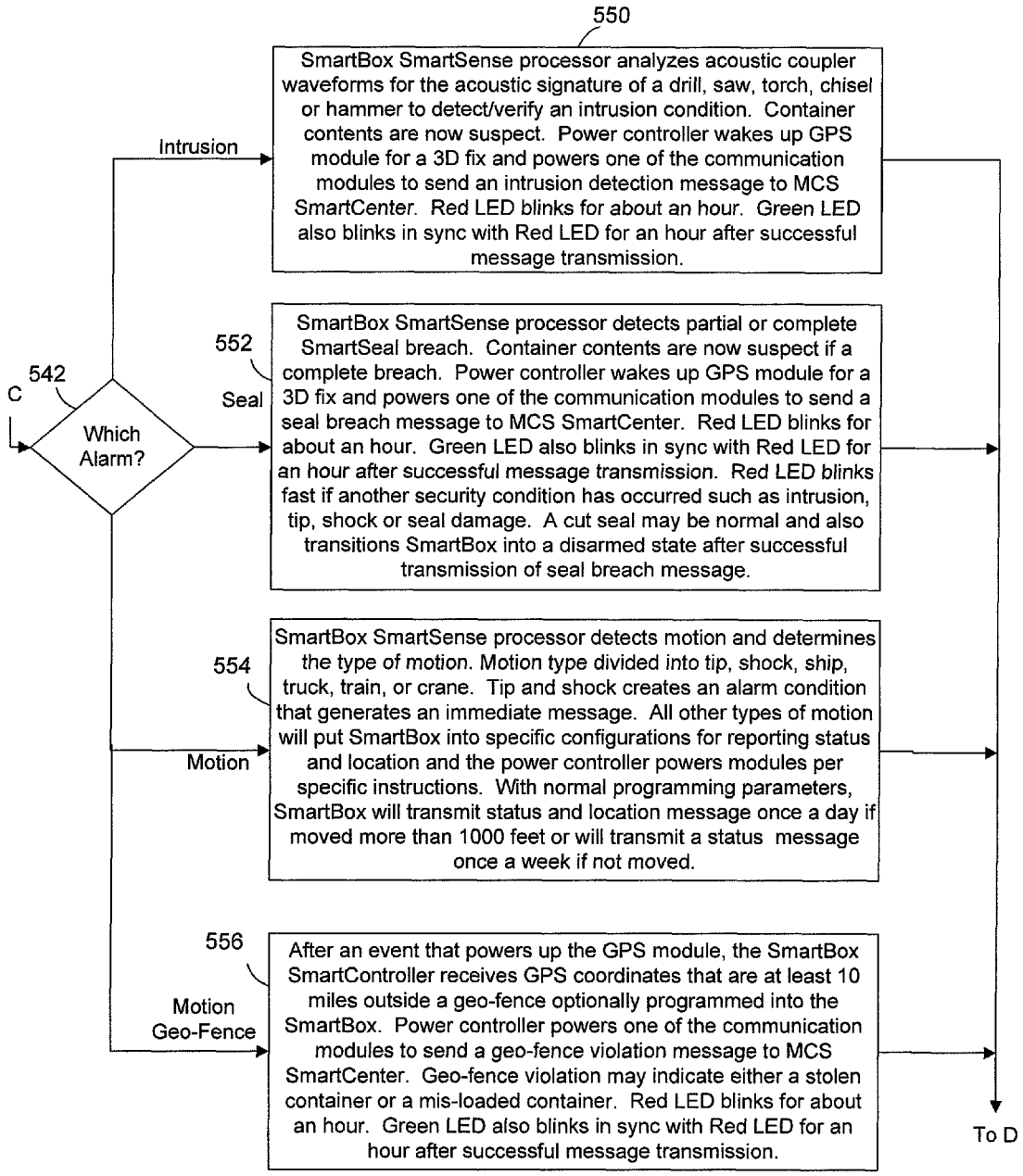

Turning to FIGS. 17A, 17B and 17C, monitoring operations shown at 500 performed by the SmartBox unit 100 once it is armed are now described. At 502 and 504, the SmartBox maintains a low power mode until a SmartSeal unit 200 is inserted. At 510, the SmartBox unit wakes up, configures itself and generates controls to the indicators 130 and 132 depending on authentication of the SmartSeal unit 200, etc. At 512, the SmartBox unit powers up the GPS module 1070 and determines its position (and/or the time) when the SmartSeal unit is inserted into the SmartSeal connector 108, and logs this information in the memory 1020. At 514, the SmartBox waits for the end of the SmartSeal cable 210 to be inserted through the one-way passageway 120 and then verifies whether the end of the cable 210 inserted through the one-way passageway is a cable that belongs to the SmartSeal unit 200 which has been plugged into the connector 108.

As shown at 516, a predetermined period of time is allotted for determining whether the SmartBox is armed with the new SmartSeal unit 200 that has been inserted. If not, then the process proceeds to 518, 520 and 522 until the SmartBox is armed. Once the SmartBox unit is armed, then at 530 the process proceeds where the SmartBox system controller 1010 controls the indicator 130 to blink for a period of time as stated at 530. At 532, the SmartBox logs the time and position of arming of the SmartBox and transmits an arming message to the SmartCenter administration facility. Power configuration of the SmartBox unit occurs at 534.

At 536, the power controller module 1030 selectively powers up the various sensors in modules 1080, 1090 and 1100 to detect for motion, intrusion, and SmartSeal breach based on stored configuration parameters and battery levels.

When an alarm condition is detected at 540, the nature of the alarm is determined at 542 and then one of the several actions at 550, 552, 554 and 556 are performed depending on the nature of the alarm. Thereafter, at 560, the module 1090 determines whether the SmartBox is on a ship and if so makes limited attempts to obtain a GPS position and transmit a message to the SmartCenter administration facility representative thereof.

At 580, the system controller 1010 determines whether the SmartSeal cable has been cut. If the SmartSeal cable has been cut, the SmartBox goes into a disarmed state and then into a sleep mode after it transmits any pending messages to the SmartCenter.

If the SmartSeal cable has not been cut, then the process goes to 570 where the SmartBox unit goes into a power conservation mode, and thereafter to 536 for cycling through the various sensor functions.

Figure 18A:
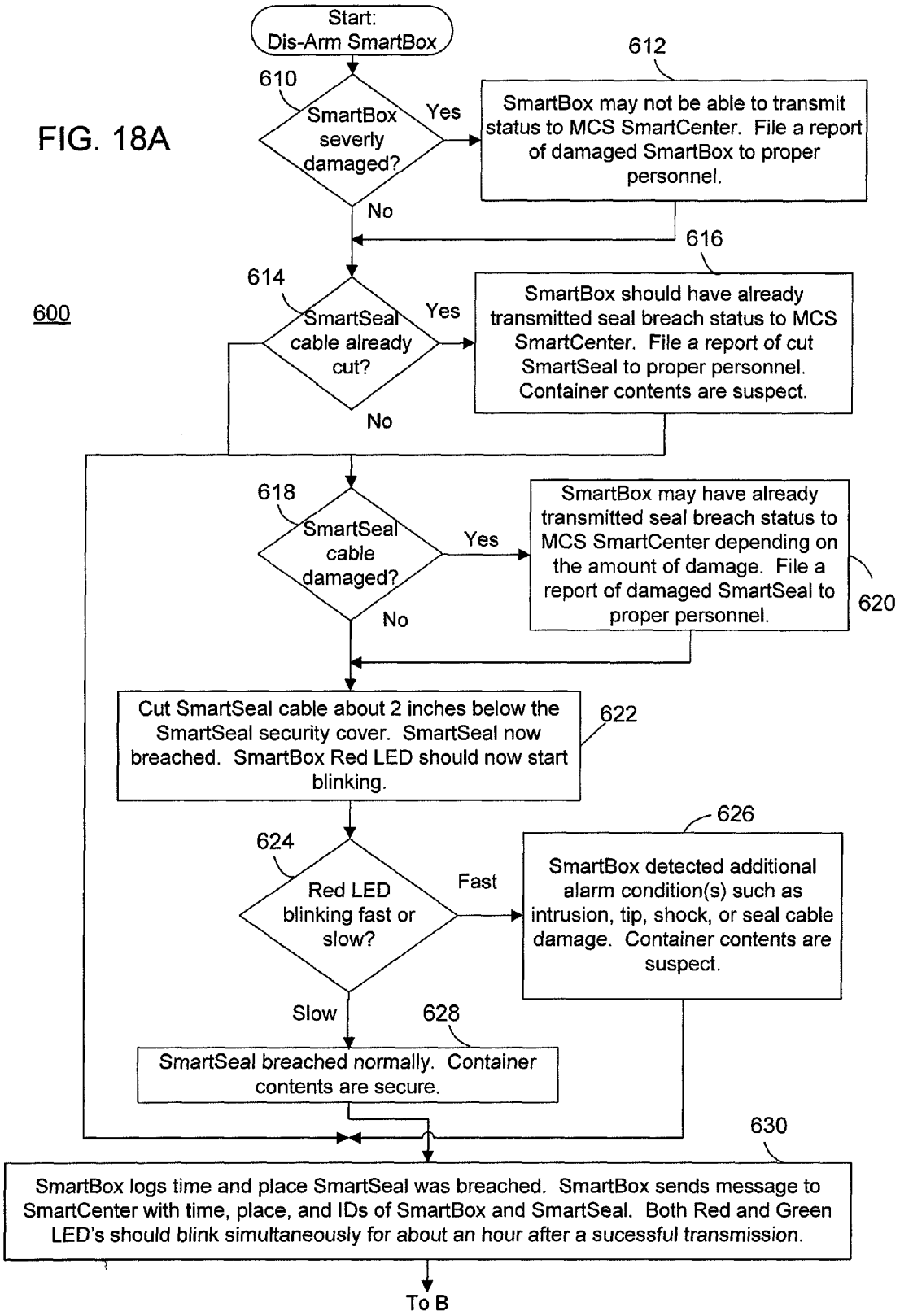
FIGS. 18A and 18B depict a flow chart that illustrates steps for disarming a SmartBox unit according to an embodiment.
Figure 18B:
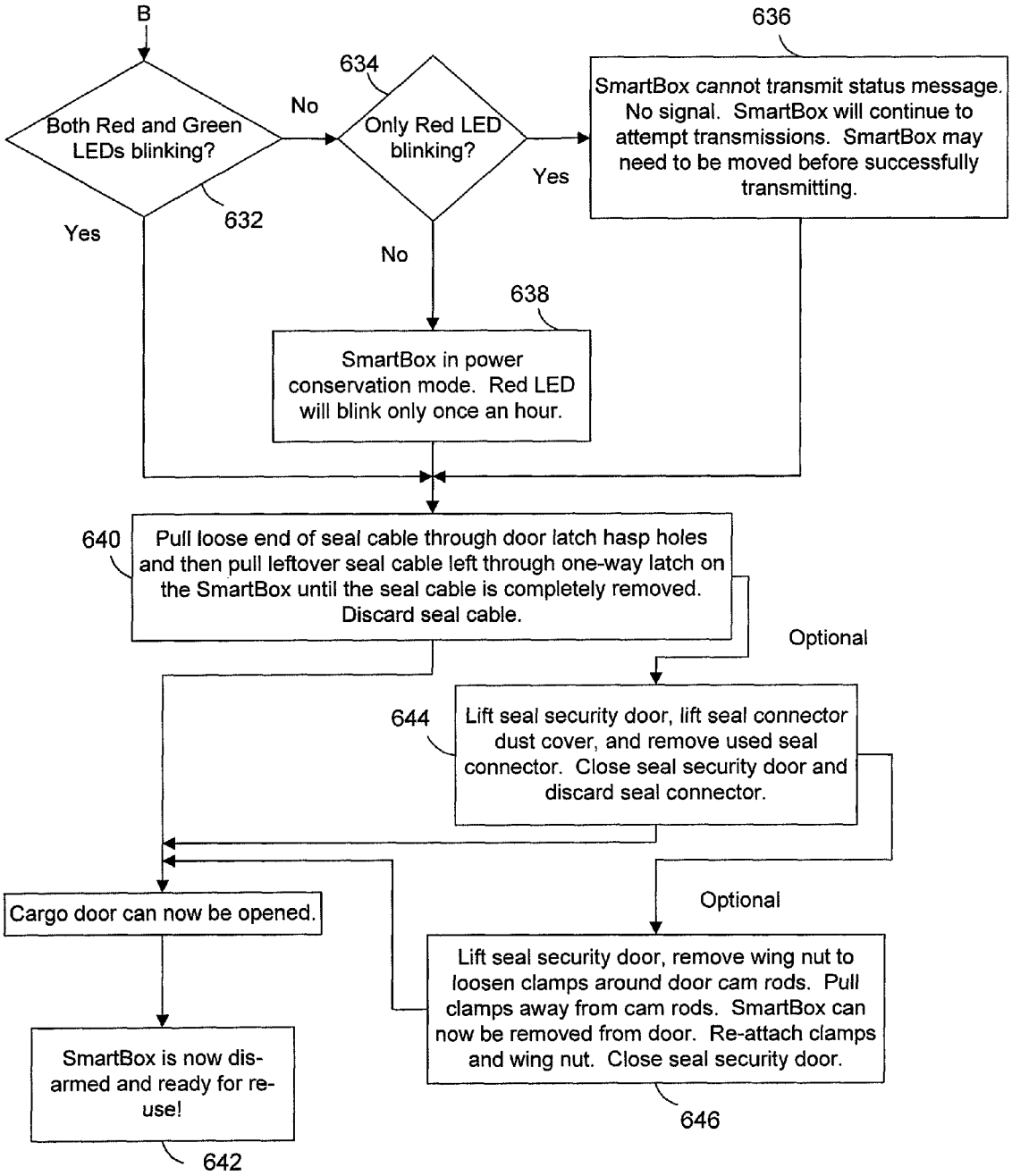

Turning to FIGS. 18A and 18B, a procedure 600 is described for disarming an armed SmartBox unit 100. Steps 610 and 612 are for the situation when the SmartBox unit 100 has suffered severe damage. Steps 614 and 616 deal with the situation when the SmartSeal cable 210 has already been cut. Steps 618 and 620 deal with the situation when the SmartSeal cable 210 has been damaged.

Assuming none of the situations above are present at the time it is desired to disarm the SmartBox unit 100, at 622 the SmartSeal cable 210 is cut, for example, at approximately two inches below the protective cover 114 of the door member 110. When the SmartSeal cable 210 is cut, the SmartBox controller 1010 will detect this event and control the visual indicator 132 on the SmartBox to start blinking (either at a fast rate or slow rate). At 624, the user determines whether the visual indicator 132 is blinking fast or slow. If the indicator 132 is blinking fast, then at 626 the SmartBox unit 100 had detected an alarm condition such as an intrusion of the container, a tipping of the container, and shock to the container or damage to the SmartSeal cable of the SmartSeal unit 200. As such, the contents of the cargo container are suspect. On the other hand, if the indicator 132 is blinking slowly, then at 628, the SmartSeal unit has been disarmed (breached) normally and the contents of the cargo container are deemed to be secure.

Next, at 630, the SmartBox unit 100 logs the time and place associated with disarming of the device 10 and transmits a message to the SmartCenter facility indicating that information together with the identifiers of the SmartBox unit 100 and SmartSeal unit 200. The SmartBox system controller 1010 will control both indicators 130 and 132 to blink for a fixed period of time, e.g., one hour, after the successful transmission of the disarming confirmation message to the SmartCenter facility. Thus, if the SmartBox unit 100 was not able to successfully transmit the disarming confirmation message, the SmartBox unit will control only the indicator 132 to blink.

At 632, the user determines whether both indicators 130 and 132 are blinking. If not, and only indicator 132 is blinking at 634, then at 636 the SmartBox unit 100 was not able to successfully transmit the disarming confirmation message and will continue attempting to transmit the disarming confirmation message. The user may be instructed to move the SmartBox unit to a different position in order to transmit the disarming message.

If neither indicator is blinking as determined at 634, then the SmartBox unit 100 is in a power conservation mode and the indicator 132 is controlled to blink at a very slow rate, e.g., once per hour.

When both indicators 130 and 132 are blinking (indicating a successful disarming confirmation message transmission), at 640 the user may pull the loose ends of the SmartSeal cable from the SmartBox and hasps of the cargo door and discard the SmartSeal unit 200. At 642, the cargo container door can then be opened. At this point, the SmartBox unit 100 is disarmed and ready for re-use with a new SmartSeal unit 200.

Optional steps after the SmartSeal unit 200 is removed from the SmartBox 100 may be performed as shown at 644 and 646.

Figure 19A:
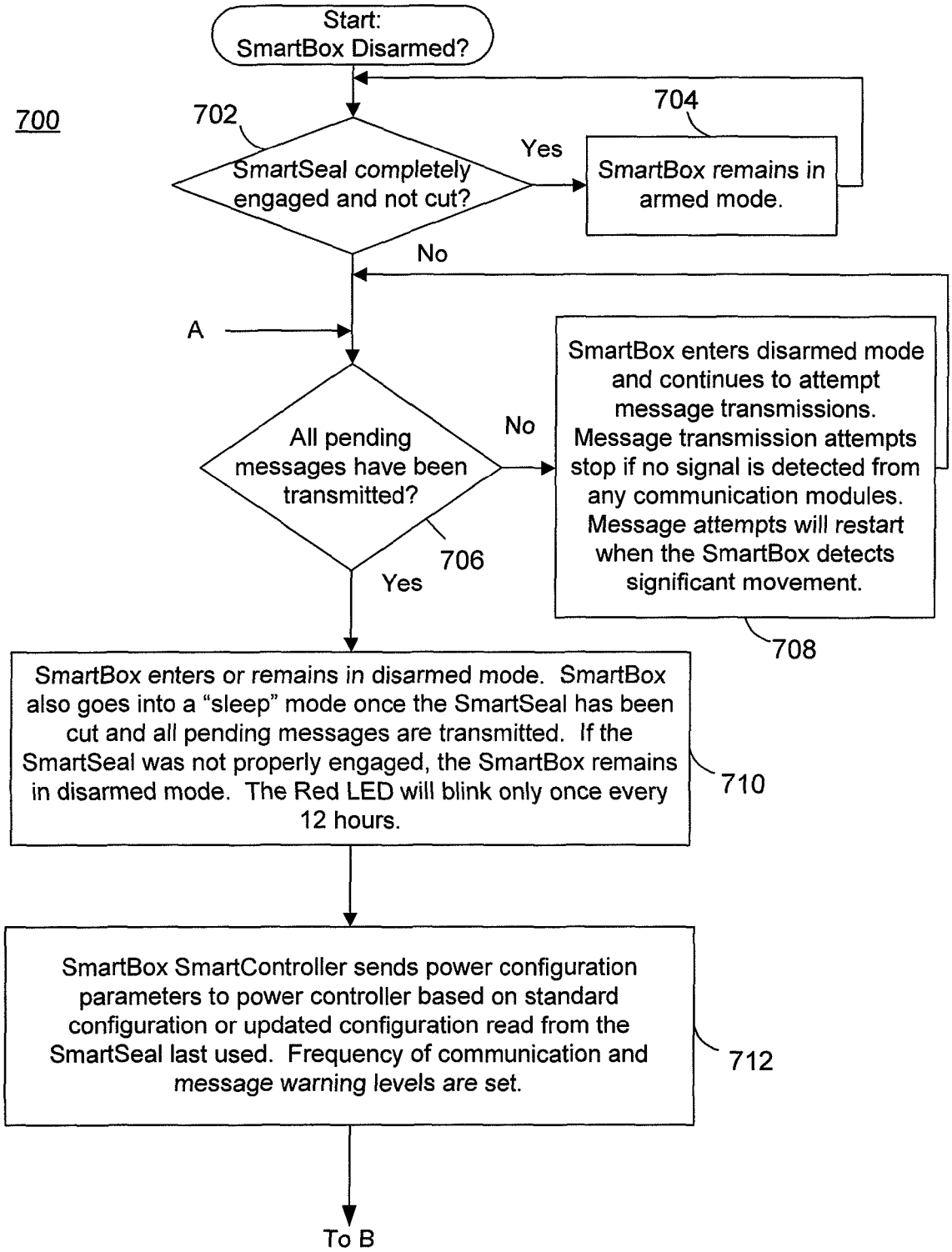
FIGS. 19A and 19B depict a flow chart that illustrates operation of a SmartBox unit when in a disarmed state according to an embodiment.
Figure 19B:
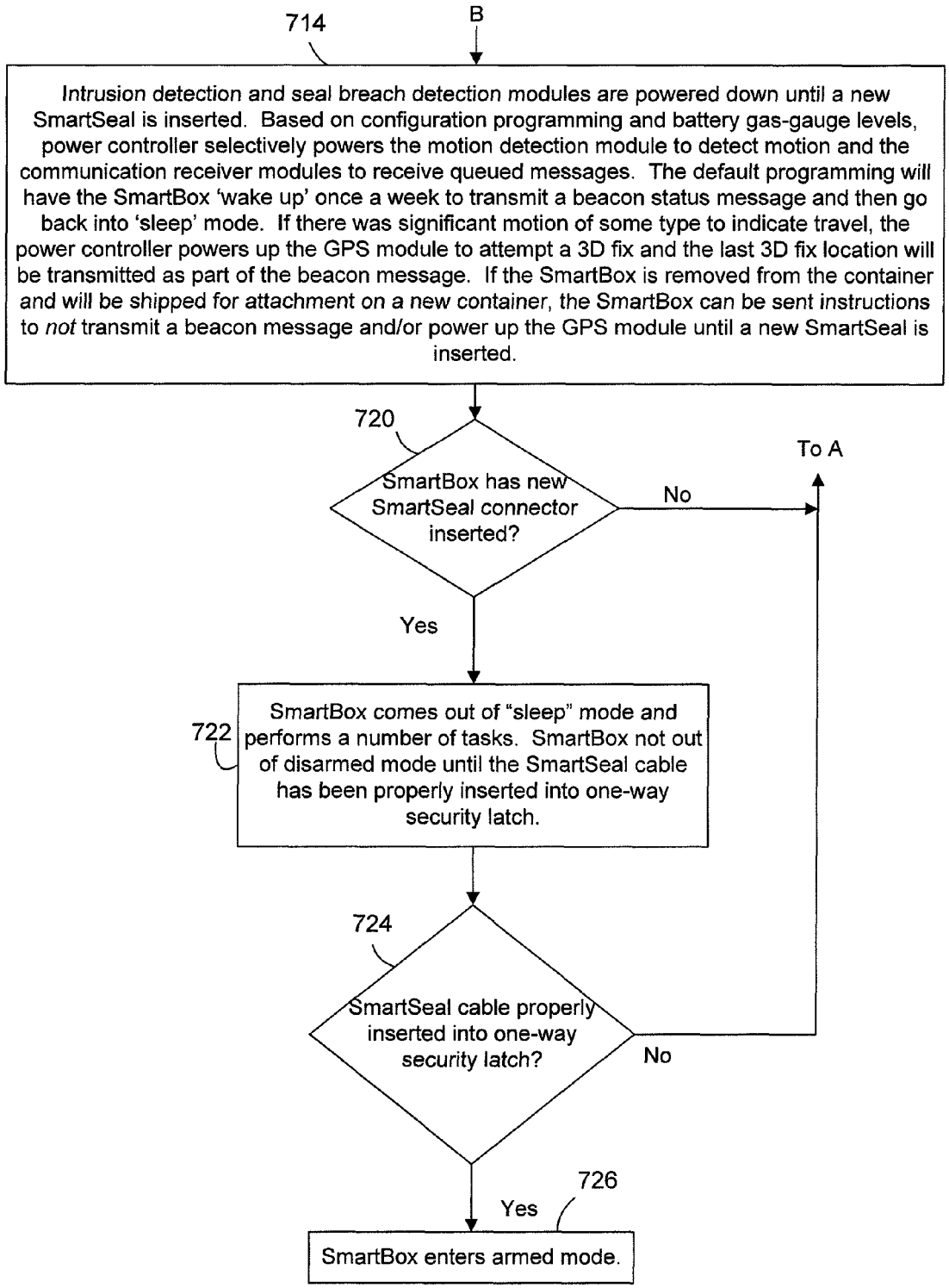

Turning to FIGS. 19A and 19B, the operation 700 of the SmartBox unit 100 after it has been disarmed are now described. At 702 and 704, the SmartBox unit 100 is still armed because the SmartSeal unit 200 is still engaged and the cable 210 has not been cut. However, once the SmartSeal cable has been cut and the SmartSeal unit removed from the SmartBox unit 100, the SmartBox unit 100 determines whether all pending messages queued up by the SmartBox system controller 1010 have been successfully transmitted. If not, then attempts to transmit those messages are made at 708.

Otherwise, if the SmartBox unit has successfully transmitted all of its pending messages, then at 710 the SmartBox unit enters or remains in the disarmed state or mode. At 712, the SmartBox system controller 1010 configures the power control parameters of the SmartBox. Other communication and message warning parameters are set as well. At 714, the SmartBox controller powers down the intrusion detection module 1080 and the SmartSeal receptacle and security controller 1100 until a SmartSeal unit 200 is inserted into the SmartBox 100.

When a new SmartSeal unit 200 is inserted into the SmartBox 100 at 720, the SmartBox system controller 1010 wakes up and performs various configuration and test tasks to prepare the SmartBox unit to become armed through the necessary action shown at 724 to ultimately enter the armed state or mode at 726.

Figure 20B:
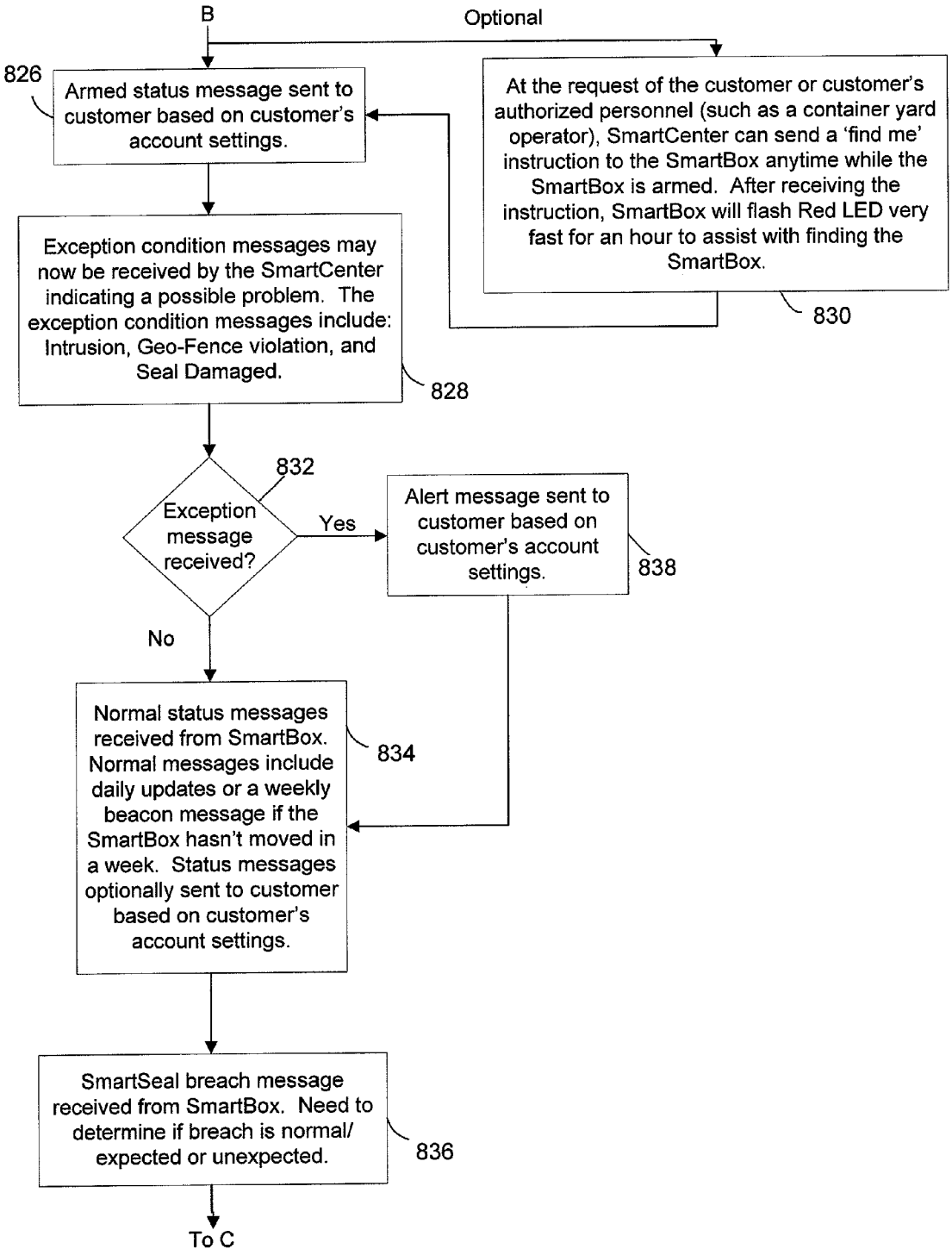
Figure 20C:
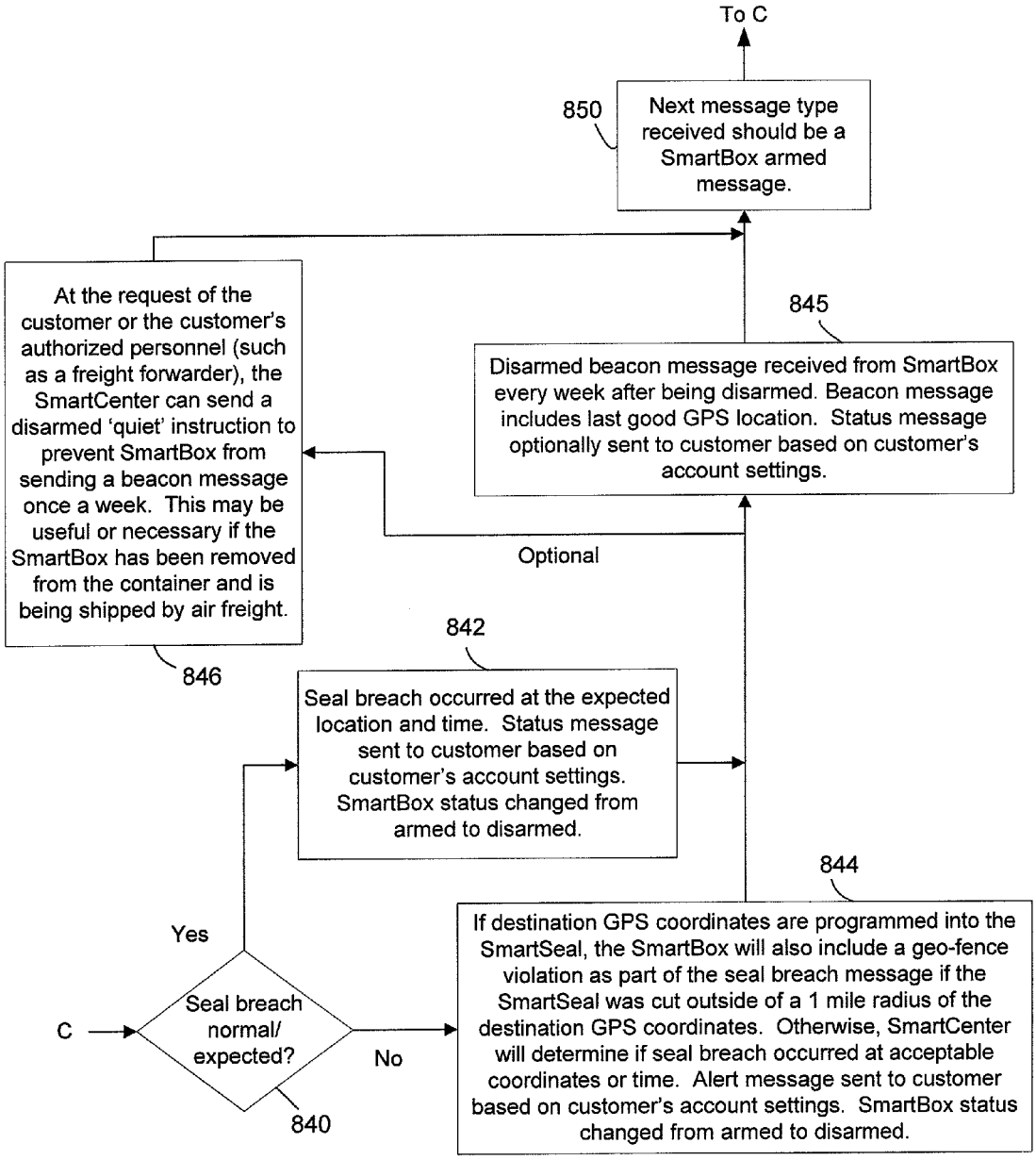

FIGS. 20A, 20B and 20C show a flow chart that depicts operations 800 of the SmartCenter administration facility according to an embodiment of the present invention. At 802, the SmartCenter receives messages from a container seal device 10 (SmartBox/SmartSeal combination) including arming status as well as GPS position and identifiers of the SmartBox and SmartSeal units. The SmartCenter then checks these identifiers against records in its data base to verify that the particular SmartBox and SmartSeal units are being used properly.

At 804 and 806, if it is determined that the SmartBox and SmartSeal identifiers do not match data in the database as being associated with a customer account settings, etc., an alert message is sent to the customer to which those identifiers are assigned. The message may be sent by any of a variety of means including email, wireless messaging, telephone call, etc. A similar analysis is made at 808 and 810 with respect to the GPS position for the SmartBox and SmartSeal units.

At 812 it is determined whether the predetermined time period has expired before the SmartBox is armed and if so an alert message is sent to the customer at 814. The SmartCenter will monitor for reception of an alarm message from the SmartBox unit at 816.

At 820, it is determined whether the SmartBox is armed and if not then at 822 an alert message is sent to the customer and at 824 only minimal functions can be performed with the SmartBox unit.

On the other hand, if the SmartCenter receives an arming message from the SmartBox is armed, then at 826 the SmartCenter sends an armed status message to the customer. At 828, the SmartCenter may receive alarm messages from the SmartBox and if a message is received at 832, then at 838 the SmartCenter sends an alert message to the customer. An optional feature is shown at 830 where the customer may send a "find me" command to the SmartCenter, after which the SmartCenter will send a "find me" command to the SmartBox to trigger the SmartBox indicators to blink for a certain period of time to assist a user in finding the SmartBox. If no alarm or exception message is received from the SmartBox, then normal status messages are received from the SmartBox at 834, some of which may be relayed to the customer according to customer account settings.

When SmartSeal breach message is received from a SmartBox at 836, the SmartCenter determines at 840 whether the breach is normal or expected. If the breach is normal or expected in terms of time and place of the breach, then at 842 the SmartCenter sends a status message to the customer and the SmartBox changes its status from armed to disarmed. If the breach is not normal or expected in terms of time and/or place of the breach, the SmartCenter performs some analysis as set forth at 844 and sends an alert message to the customer accordingly.

Next, at 845, the SmartCenter will receive a disarmed beacon message from the SmartBox periodically after it has been disarmed. Thereafter, at 850, the next message received from the SmartBox should be a SmartBox armed message. At 846, an optional function may be performed whereby the SmartCenter sends a disarmed "quiet" instruction to the SmartBox to prevent it from sending a beacon message.

Possible Variations and Modifications to the Container Seal System

One alternative embodiment is for the disposable SmartSeal unit 200 to be a single unit comprising a hardened steel bolt or shaft (e.g., approximately 6" long) with a battery pack securely mounted to one end. The battery pack contains five AA-size batteries mounted around the end of the bolt. The SmartSeal unit 200 also contains an electrically readable ID number, also printed on its outside. To seal the container, the shipper holds the SmartSeal unit 200 by the battery-pack end in one hand and, in a single motion, passes the bolt through the hasps and handle on the container door and on into a protrusion from the SmartBox unit 100 until a positive "click" is felt. To remove the SmartSeal unit 200 and open the container, the hardened bolt is cut with bolt cutters between the hasps and the SmartBox unit 100 and the battery end discarded. The small remaining piece of the hardened bolt is flicked out with one finger and also discarded. The SmartBox unit is then ready to be sealed again as required. This embodiment may be simpler than existing, non-electronic, seals which come in two pieces and require two hands to join the two pieces.

Illustrative and Non-Limiting Example of Use of the Container Seal System

The following is a description of how this technology solutions described herein may apply in a real-world intermodal example.

A shipping line (such as Maersk and, NYK or CSX) or a container leasing company purchases and schedules installation of the SmartBox units 100 to its fleet of cargo containers. A field installation engineer installs the device by drilling any necessary holes in the container door, securing the SmartBox unit 100 to the container door with appropriate with give-away locking nuts, welding, or other tamper-resistant means. The SmartCenter administration facility activates the SmartBox unit 100 and builds the relationship of the SmartBox unit 100 and the container in the central database. If the container to be sealed is an empty container, then an Empty-type Smart Seal unit 200 is passed between the container door closure locking hasps and connected to the SmartBox unit 100. The container is now tracked and secure. The container seal device 10 comprised of the SmartBox unit 100/SmartSeal unit 200 sends notification of an armed container to the SmartCenter administration facility. The software at the SmartCenter facility issues the shipping line or leasing company a personal identification number (PIN) for control, armament, disarmament and data access. The shipping line can now access, monitor and insure their asset's security and monitoring information from any Internet-ready device by using a web browser to access the SmartCenter facility functions and enter their assigned user ID and PIN.

Next, a customer contacts the shipping line and indicates to the shipping line a need for movement of cargo. The shipping line user can log into the SmartCenter administration facility via the Internet and enter the GPS coordinates (or other geographical position identifier) of the customer's location, or instruct for the SmartCenter facility to send an alert message to the customer or trucking line to contact the shipping line upon arrival of the cargo at the customer's location. The shipping line loads a SmartBox unit 100-equipped container with the desired cargo and inserts a SmartSeal unit 200 to the SmartBox unit 100 to seal the container. If the shipping vehicle is a truck, a SmartBox unit 100 may also be installed on the truck itself for tracking and monitoring purposes. The container is ultimately transported to the customer's designated delivery location for cargo loading. Upon arrival to the customer's delivery destination (also identified by the GPS coordinates or geographical position information supplied to the SmartCenter facility), the SmartCenter facility transmits a disarm message (described above) to the SmartBox unit 100, which in response activates the indicator 130 on the SmartBox unit 100 to show that the SmartSeal unit 200 can be safely removed.

If an Empty-type SmartSeal unit 200 was used to seal the container for transport to the customer's designated location, then the SmartSeal unit 200 is removed (and in so doing destroying it) and the customer can then load their cargo into the container and reseal the container with a Shipping-type SmartSeal unit 200 unit and the SmartBox unit 100 on the container will send an "armed" notification back to the SmartCenter facility which is in response generates a new PIN and sends the new PIN to customer. The customer can then input new destination GPS coordinates for disarming of the SmartBox unit at the proper destination, and/or make additional manual arrangements with the receiver. The container then starts its journey to its destination using a best way of travel pre-negotiated by the customer and shipping line (rail, sea, air and/or truck).

On the other hand, if cargo was already loaded into the shipping container for delivery to the customer's designated destination, then a Shipping-type SmartSeal unit 200 would have been used with the SmartBox unit 100 to seal the container. The Shipping-type SmartSeal unit 200 is then disarmed subject to the container reaching the designated destination, etc.

Now assume a breach occurs during transport of the container due to an unauthorized party removing the SmartSeal unit 200 unit from the container. The SmartBox unit 100, in response to detecting the breach, immediately activates the appropriate communication module to send a breach notification, GPS coordinates of the breach, and a date/time stamp to the SmartCenter facility. The software at the SmartCenter facility logs this information to its database and notifies the designated parties (i.e., employees of the shipping company) of the breach. The shipping company is then responsible for taking the appropriate action-including re-sealing the container with another Shipping-type SmartSeal unit 200 if the container is carrying cargo.

During the journey, the container may reach a Customs authority operation if the container crosses a country border, and the Customers authority may select the container for inspection. The Customs authority may communicate with the SmartCenter facility advising it that it wishes to disarm the SmartBox unit 100 on the container in order to inspect the container. The Customs authority will send an appropriate identification number that the SmartCenter evaluates and authorizes before permitting the disarming procedure. If the Customs authority identification number is authorized, the SmartCenter facility transmits a disarm message to the SmartBox unit 100 for storage in the non-volatile memory of the SmartBox unit 100. In response to receiving the disarm message from the SmartCenter facility, the SmartBox unit 100 activates the indicator 130 for a period of time to indicate that the SmartSeal unit 200 can safely be removed. This disarming process is an example of an expected/normal disarming (authorized breach). When the Customs authority has completed its inspection, a new Customs-type SmartSeal unit 200 is connected to the SmartBox unit 100 and this information is once again logged in the database of the SmartCenter facility. The container then goes about its journey until it reaches the customer's designated destination (receiver location). The SmartBox unit 100 is disarmed upon reaching the proper destination similar to that described above.

Another way to arm and disarm a SmartBox unit is via the keypad 138 shown in FIG. 3. A numeric (or alphanumeric) identifier (arming code) may be generated by the SmartCenter facility and transmitted (via the Internet) to an entity that is to arm a particular SmartBox unit 100. In use, a person enters the arming code into keypad 138 (before or after) a SmartSeal unit 200 has been properly inserted and connected into the SmartBox unit 200. The SmartCenter facility may generate the arming code such that it is unique to the particular SmartBox unit 100 and SmartSeal unit 200, and cannot be used to arm any other units. Similarly, the SmartCenter facility may generate a disarming code that is transmitted to an entity that is to disarm a particular SmartBox unit 100 in order to gain authorized access to a container to which the SmartBox unit 100 is affixed. A person enters the disarming code into the keypad 138 (before or after) the cable 210 of the SmartSeal unit 200 is cut and removed from the SmartBox unit 200. A disarming confirmation message is transmitted only if the proper disarming code was entered into the SmartBox unit to confirm an authorized disarm (breach). If no code is entered or an incorrect code is entered, then the SmartBox unit 100 would transmit an alert message to the SmartCenter facility indicating that an unauthorized breach has occurred by way of an incorrect or (no) disarming code.

The container seal device and container monitoring system described herein may support any industry or asset requiring security or logistics tracking. Complete installation of the container seal device takes less than a half hour. The installer may configure all permanent information such as container title, number, and all container specifications, as well as notification information. Once the container is loaded, it is secured using the SmartSeal unit and is ready to begin container tracking, monitoring security status, and controlling authorized access. Access to location information of a container is available at any time by accessing the SmartCenter administration facility.

The SmartBox unit stores data for all authorized openings (arm/disarm), breaches, other detected events, as well as location coordinates for several years worth of operation. This information is date and time stamped and the history is accessible to designated users by logging in the SmartCenter facility. In the event of catastrophic damage to the SmartBox unit, information which had not yet been transmitted to the SmartCenter may be recovered from the memory in the SmartBox unit.

This end-to-end solution provides many benefits for all types of users throughout the supply chain, such as:

Real-time container tracking. Track container(s) location and history of where the container is and has been at any time by web-based access to the SmartCenter facility.

Real-time security monitoring. Monitor the security status of container(s) at any time via the SmartCenter facility.

Real-time breach notification. Receive immediate digital notification of any breach or unauthorized activity.

Control authorized access. Disarm the SmartSeal unit 200 unit to allow authorized access to a container.

The system and methods described herein may be embodied in other specific forms without departing from the spirit or essential characteristics thereof. The foregoing embodiments are therefore to be considered in all respects illustrative and not meant to be limiting.

What is claimed is:

1. A container monitoring system comprising:

an administration facility and a seal device for a shipping container;

the seal device comprising:

a first unit that is configured to be affixed to a shipping container, the first unit containing a control system and comprising a connector;

a second unit that is configured to engage with an element of a door of a shipping container to which the first unit is affixed and to electrically connect with the control system in the first unit, wherein the second unit comprises a connector and a cable having a first end and a second end, the first end of the cable connected to the connector of the second unit and the connector of the second unit being configured to mate and electrically connect with the connector of the first unit, and comprising a wire within the cable that extends substantially the entire length of the cable;

wherein the second unit comprises a memory that stores data indicating which of a plurality of function types the seal device is to perform when the second unit is electrically connected to the first unit;

wherein the first unit comprises a housing that contains the control system and having a passageway that is configured to permit the second end of the cable to pass through but which prevents the cable from being withdrawn from the passageway once it is has been inserted without cutting the cable;

wherein the control system is configured to generate a signal having a predetermined unique time-varying pulse train pattern that is applied to the wire at the first end of the cable so that the wire acts like a broadcast antenna to emit the pulse train, and wherein the control system comprises a detector that is configured to detect energy radiated from the wire along a length portion of the cable that is contained within the passageway of the housing to verify that the cable connected to the first unit is the same cable that is inserted into the passageway of the housing by analyzing the detected energy to determine whether it contains the same predetermined time-varying pulse train pattern applied to the wire at the first end of the cable;

wherein the control system of the first unit comprises a main controller that detects when the second unit is electrically connected to the first unit and establishes an armed state during which the main controller monitors conditions of the second unit to detect a breach of the second unit that is indicative of access to the shipping container to which the first unit is attached;

wherein the main controller in the first unit generates one or more disarm identifiers for the seal device depending on the function type the seal device is configured to perform;

wherein the control system of the first unit comprises a global positioning system (GPS) device that receives global positioning signals in order to determine a position of the shipping container to which the first unit is affixed, and one or more communication modules capable of wireless communication for transmitting the position of the shipping container; and wherein the administration facility communicates with the seal device in order to track conditions of the seal device including the geographical position of the seal device and occurrence of a breach of the second unit during the armed state and to transmit a disarm message to the first unit, and wherein the main controller of the first unit is responsive to the disarm message to activate a visual indicator on the first unit.

2. The container monitoring system of claim 1, wherein the cable further comprises a twisted pair wire loop extending therethrough, and wherein the control system is configured to supply a pulse train to the twisted pair wire loop at a slower rate than the pulse train supplied to the wire, wherein the control system is further configured to detect radiation from the twisted pair wire loop in the passageway of the housing for further verifying that the cable connected to the first unit is the same cable that is inserted into the passageway of the housing, and wherein the main controller establishes the armed state once the cable has been inserted into the passageway.

3. The container monitoring system of claim 1, wherein the cable comprises one or more conductors and/or optical fibers, and the main controller monitors the one or more conductors and/or optical fibers to detect when the cable is cut.

4. The container monitoring system of claim 1, and further comprising at least one sensor that is coupled to the main controller in the first unit and which detects a condition indicative of an intrusion into the shipping container.

5. The container monitoring system of claim 4, wherein the at least one sensor comprises an acoustic sensor that monitors vibrations in a wall of the shipping container.

6. The container monitoring system of claim 1, wherein the main controller in the first unit generates a disarming confirmation message for transmission via one of the communication modules to the administration facility upon determining that the seal device has been breached at a geographical position where a breach of the seal device is authorized.

7. The container monitoring system of claim 1, wherein the second unit is configured for a single use and is disposable after the single use.

8. The container monitoring system of claim 1, and further comprising a digital camera coupled to the main controller of the first unit, wherein the digital camera is positioned in the first unit so as to capture images of a person attempting access into the container through the container door or interacting with the first unit or second unit.

9. An apparatus, comprising:

a housing unit that is configured to attach to a shipping container, wherein the housing unit contains a control system comprising one or more wireless communication modules and an acoustic sensor unit configured to acoustically couple to a surface of the shipping container to detect acoustic energy therefrom and convert the detected acoustic energy into electrical signals, and a processor that is configured to analyze the electrical signals for comparison against stored waveform signatures of sources that are indicative of a potential unauthorized intrusion into the shipping container;

a seal unit comprising an engaging member that is configured to engage with a portion of a door mechanism of a shipping container to which the housing unit housing is attached, and an electrical connector attached to the engaging element and configured to electrically connect to the control system in the housing unit, wherein the seal unit comprises a power source that supplies electrical power to the control system when connected thereto;

wherein the control system in the control unit housing detects a breach of the seal unit that is indicative of access being made to the shipping container and a potential unauthorized intrusion to the shipping container based on detected acoustic energy and transmits a message indicating the breach or potential unauthorized intrusion via the one or more wireless communication modules; and wherein housing unit comprises a power source to power the control system when the seal unit is not electrically connected to the control system, and wherein the power source of the housing unit is rechargeable by said power source in the seal unit when the seal unit is electrically connected thereto.

10. The apparatus of claim 9, wherein the control system of the housing unit comprises a main controller that establishes an armed state when the seal unit electrically connects to the control unit and thereafter monitors conditions of the seal unit to detect a breach of the seal unit indicative of access to the shipping container.

11. The apparatus of claim 9, wherein the acoustic sensor unit comprises first and second acoustic couplers configured to be mounted or otherwise acoustically coupled to a surface of the shipping container, wherein the first acoustic coupler is configured to detect relatively high frequency vibrations and the second acoustic coupler is configured to detect relatively low frequency vibrations, and wherein the processor is configured to be coupled to the first and second acoustic couplers and to analyze output of the first and second acoustic couplers to determine whether there is a potentially unauthorized intrusion into the shipping container.

12. The apparatus of claim 11, wherein the housing unit further comprises a motion detector, and wherein the processor is coupled to the motion detector and is further configured to analyze the outputs of the first and second acoustic couplers so as to take into account motion of the shipping container based on output from the motion detector.

13. The apparatus of claim 11, wherein the housing unit further comprises a motion detector, and wherein the processor is coupled to the motion detector and is further configured to analyze output of the motion detector and acoustic sensors to detect motion indicating that the apparatus is on a moving vessel and to control supply of power to various components of the apparatus to conserve power due to a lower likelihood of intrusion to the shipping container when it is a moving vessel.

14. The apparatus of claim 13, and further comprising at least one communication receiver and a battery power supply, wherein the processor is further configured to selectively power up the communication receiver and motion detector based on stored configuration parameters and battery level.

15. An apparatus comprising:

first means for housing a control system and for attaching to a door of a shipping container, wherein the first means comprises means for determining a position of the first means and means for wireless communicating information stored in the control system of the first means to a remote location;

second means for engaging with an element of the door of a shipping container and for electrically connecting with the control system of the first means;

wherein the control system in the first means being configured to detect a breach of the second means indicative of access being made the shipping container;

wherein the first means comprises a keypad device configured to receive input of an alphanumeric identifier used to arm or disarm the control system;

wherein said control system stores an identifier assigned to said first means and said second means comprises a memory that stores an identifier assigned to said second means;

wherein the second means comprises a cable member and a connector unit at one end of the cable member that is configured to electrically connect with the first means;

wherein the connector unit comprises a control system comprising a memory that is configured to store the identifier assigned to the second means, and wherein the control system in the first means is configured to receive the identifier of the second means when the connector unit of the second means is connected to the first means.

16. The apparatus of claim 15, and further comprising means for sensing an intrusion into the shipping container, and wherein said control system generates a message for transmission to a remote location via said means for wireless communicating.

17. The apparatus of claim 15, wherein said first means further comprises means for capturing a digital image outside of said first means of a person attempting access into the container or entering an alphanumeric identifier into the keypad.

18. The apparatus of claim 15, wherein the second means comprises an elongated cable and one or more electrical conductors and/or optical fibers contained in the elongated cable, and wherein the control system monitors a signal representing a characteristic of the one or more electrical conductors and/or optical fibers to detect said beach.

19. A container monitoring system comprising:

an administrative facility and a seal apparatus;

wherein the seal apparatus comprises:

first means for housing a control system and for attaching to a door of a shipping container, wherein the first means comprises means for determining a position of the first means and means for wirelessly communicating information stored in the control system of the first means to a remote location;

second means for engaging with an element of the door of a shipping container and for electrically connecting with the control system of the first means;

wherein the control system in the first means being configured to detect a breach of the second means indicative of access to the shipping container; and wherein the first means comprises a keypad device configured to receive input of an alphanumeric identifier used to arm or disarm the control system;

wherein the administration facility communicates with the seal apparatus in order to track conditions of the seal apparatus including the geographical position of the seal apparatus and occurrence of said breach; and wherein the administration facility stores data comprising identifiers for the first means and for the second means, and user party identifiers that are associated with said identifiers for the first means and the second means, and the administration facility is configured to compare the identifier for a second means received from the seal apparatus against a database to determine whether the identifier of the second means is authorized.

20. The container monitoring system of claim 19, wherein said control system stores an identifier assigned to said first means and said second means comprises a memory that stores an identifier assigned to said second means, wherein the second means comprises a cable member and a connector unit at one end of the cable member that is configured to electrically connect with the first means, and wherein the connector unit comprises a control system comprising a memory that is configured to store the identifier assigned to the second means, and wherein the control system in the first means is configured to receive the identifier of the second means when the connector unit of the second means is connected to the first means.

* * * * *